US008606586B2

(12) United States Patent
Nagel et al.

(10) Patent No.: US 8,606,586 B2
(45) Date of Patent: Dec. 10, 2013

(54) BANDWIDTH EXTENSION ENCODER FOR ENCODING AN AUDIO SIGNAL USING A WINDOW CONTROLLER

(75) Inventors: Frederik Nagel, Nuremberg (DE); Markus Multrus, Nuremberg (DE); Sascha Disch, Fuerth (DE); Jeremie Lecomte, Fuerth (DE); Christian Ertel, Schwaig (DE); Patrick Warmbold, Emskirchen (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 61 days.

(21) Appl. No.: 13/335,096

(22) Filed: Dec. 22, 2011

(65) Prior Publication Data

US 2012/0158409 A1 Jun. 21, 2012

Related U.S. Application Data

(63) Continuation of application No. PCT/EP2010/059025, filed on Jun. 24, 2010.

(30) Foreign Application Priority Data

Feb. 12, 2010 (EP) ..... 10153530

(51) Int. Cl.
*G10L 19/02* (2013.01)
*G10L 19/00* (2013.01)

(52) U.S. Cl.
USPC ..... 704/500; 704/206

(58) Field of Classification Search
None
See application file for complete search history.

(56) References Cited

U.S. PATENT DOCUMENTS

| | | | | |
|---|---|---|---|---|
| 6,636,830 | B1 * | 10/2003 | Princen et al. | 704/204 |
| 7,389,226 | B2 * | 6/2008 | Chu | 704/211 |
| 7,953,605 | B2 * | 5/2011 | Sinha et al. | 704/501 |
| 2001/0044722 | A1 * | 11/2001 | Gustafsson et al. | 704/258 |
| 2002/0128839 | A1 * | 9/2002 | Lindgren et al. | 704/258 |
| 2010/0049342 | A1 * | 2/2010 | Ramabadran et al. | 700/94 |

FOREIGN PATENT DOCUMENTS

| | | |
|---|---|---|
| EP | 1672618 | 6/2006 |
| JP | 2006518482 | 8/2006 |
| WO | 0126095 A1 | 4/2001 |
| WO | WO-2004072956 | 8/2004 |

OTHER PUBLICATIONS

International Search Report PCT/EP2010/059025; Dated Aug. 10, 2010; 4 pages.

* cited by examiner

*Primary Examiner* — Talivaldis Ivars Smits
(74) *Attorney, Agent, or Firm* — Michael A. Glenn; Glenn Patent Group

(57) ABSTRACT

A bandwidth extension encoder for encoding an audio signal has a signal analyzer, a core encoder, a parameter calculator, and a window controller. The audio signal has a low frequency signal having a core frequency band and a high frequency signal having an upper frequency band. The signal analyzer is configured for analyzing the audio signal, the audio signal having a block of audio samples, the block having a specified length in time. The signal analyzer is furthermore configured for determining from a plurality of analysis windows an analysis window to be used for performing a bandwidth extension in a bandwidth extension decoder. The core encoder is configured for encoding the low frequency signal to acquire an encoded or frequency signal. The parameter calculator is configured for calculating bandwidth extension parameters from the high frequency signal. The window controller is configured to provide control information indicating analysis window functions.

26 Claims, 15 Drawing Sheets

(BANDWIDTH EXTENSION ENCODER)

(BANDWIDTH EXTENSION ENCODER)

(BANDWIDTH EXTENSION DECODER)

(ENCODER SIDE)

(DECODER SIDE)

(ENCODER SIDE)

(DECODER SIDE)

(COMPARATOR)

(ENCODER SIDE)

(SIGNAL CLASSIFIER)

(ENCODER SIDE)

(DECODER SIDE)

(PHASE VOCODER PROCESSOR)

(DECODER SIDE)

(DECODER SIDE)

BANDWIDTH EXTENSION ENCODER FOR ENCODING AN AUDIO SIGNAL USING A WINDOW CONTROLLER

CROSS-REFERENCE TO RELATED APPLICATIONS

This application is a continuation of International Application No. PCT/EP2010/059025, filed Jun. 24, 2010, which is incorporated herein by reference in its entirety, and additionally claims priority from U.S. Application No. 61/221,442, filed Jun. 29, 2009 and European Application No. EP 10153530.0, filed Feb. 12, 2010, which are all incorporated herein by reference in their entirety.

BACKGROUND OF THE INVENTION

The present invention relates to audio signal processing and, in particular, to a bandwidth extension encoder, a method for encoding an audio signal, a bandwidth extension decoder, a method for decoding an encoded audio signal, a phase vocoder and an audio signal.

Moreover, embodiments of the present invention relate to an application of a phase vocoder for pure time stretching, independent of a bandwidth extension.

Storage or transmission of audio signals is often subject to strict bit rate constraints. These constraints are usually accounted for by the use of encoders/decoders ("codecs") that efficiently compress the audio signal in terms of the information rate needed to store or transmit the signal. In the past, coders were forced to drastically reduce the audio bandwidth when only a very low bit rate was available. Modern audio codecs are able to code wide-band signals by using bandwidth extension (BWE) methods, as described in M. Dietz, L. Liljeryd, K. Kjörling and O. Kunz, "Spectral Band Replication, a novel approach in audio coding," in 112th AES Convention, Munich, May 2002; S. Meltzer, R. Böhm and F. Henn, "SBR enhanced audio codecs for digital broadcasting such as "Digital Radio Mondiale" (DRM)," in 112th AES Convention, Munich, May 2002; T. Ziegler, A. Ehret, P. Ekstrand and M. Lutzky, "Enhancing mp3 with SBR: Features and Capabilities of the new mp3PRO Algorithm," in 112th AES Convention, Munich, May 2002; International Standard ISO/IEC 14496-3:2001/FPDAM 1, "Bandwidth Extension," ISO/IEC, 2002; "Speech bandwidth extension method and apparatus", Vasu Iyengar et al. U.S. Pat. No. 5,455,888; E. Larsen, R. M. Aarts, and M. Danessis. Efficient high-frequency bandwidth extension of music and speech. In AES 112th Convention, Munich, Germany, May 2002; R. M. Aarts, E. Larsen, and O. Ouweltjes. A unified approach to low- and high frequency bandwidth extension. In AES 115th Convention, New York, USA, October 2003; K. Käyhkö. A Robust Wideband Enhancement for Narrowband Speech Signal. Research Report, Helsinki University of Technology, Laboratory of Acoustics and Audio Signal Processing, 2001; E. Larsen and R. M. Aarts. Audio Bandwidth Extension—Application to psychoacoustics, Signal Processing and Loudspeaker Design. John Wiley & Sons, Ltd, 2004; E. Larsen, R. M. Aarts, and M. Danessis. Efficient high-frequency bandwidth extension of music and speech. In AES 112th Convention, Munich, Germany, May 2002; J. Makhoul. Spectral Analysis of Speech by Linear Prediction. IEEE Transactions on Audio and Electroacoustics, AU-21(3), June 1973; U.S. patent application Ser. No. 08/951,029, Ohmori, et al. Audio band width extending system and method; U.S. Pat. No. 6,895,375, Malah, D & Cox, R. V.: System for bandwidth extension of Narrow-band speech and Frederik Nagel, Sascha Disch, "A harmonic bandwidth extension method for audio codecs," ICASSP International Conference on Acoustics, Speech and Signal Processing, IEEE CNF, Taipei, Taiwan, April 2009.

These algorithms rely on a parametric representation of the high-frequency content (HF). This representation is generated from the low-frequency part (LF) of the decoded signal by means of transposition into the HF spectral region ("patching") and application of a parameter driven post processing.

In the art, methods of bandwidth extension such as spectral band replication (SBR) or harmonic bandwidth extension (HBE) are known. In the following, these two BWE methods are briefly described.

On the one hand, spectral band replication (SBR), as described in M. Dietz, L. Liljeryd, K. Kjörling and O. Kunz, "Spectral Band Replication, a novel approach in audio coding," in 112th AES Convention, Munich, May 2002, uses a quadrature mirror filterbank (QMF) for generating the HF information. Applying a so-called "patching" algorithm, lower QMF band signals are copied into higher QMF bands, leading to a replication of the information of the LF part in the HF part. Subsequently, the generated HF part is adapted to closely match the original HF part with the help of parameters that adjust the spectral envelope and the tonality.

On the other hand, harmonic bandwidth extension (HBE) is an alternative bandwidth extension scheme based on phase vocoders. HBE enables a harmonic continuation of the spectrum as opposed to SBR, which relies on a non-harmonic spectral shift. It may be utilized to replace or amend the SBR patching algorithm.

U.S. Provisional Patent Application with the application No. 61/079,841 discloses a BWE method, which may choose between alternative patching algorithms that operate either in frequency domain or in time domain. In the time-frequency transform by the filterbank, a certain predetermined analysis window is applied. Moreover, classic phase vocoder implementations according to the state-of-the-art use one predefined window shape such as a raised-cosine window or a Bartlett window.

However, choosing one predetermined analysis window for vocoder applications encompasses a trade-off to be made by the application designer in terms of overall perceptual audio quality achieved for different classes of audio signals. Thus, although the mean audio quality can be optimized by the initial choice of a certain window, the audio quality for each individual class of signals remains to be sub-optimal.

Moreover, it was found that certain signals benefit from using specialized analysis windows for a phase vocoder, which may especially be used for temporally spreading the audio signal without modifying the pitch of the same.

Therefore, a concept for selecting the optimal analysis windows such as within a BWE scheme is needed. However, measures against the just-mentioned degradation of the perceptional audio quality should advantageously not result in a significantly increased computational complexity of the employed codecs.

SUMMARY

According to an embodiment, a bandwidth extension encoder for encoding an audio signal, the audio signal having a low frequency signal having a core frequency band and a high frequency signal having an upper frequency band, may have a signal analyzer for analyzing the audio signal, the audio signal having a block of audio samples, the block having a specified length in time, wherein the signal analyzer is configured for determining, from a plurality of analysis windows, an analysis window to be used for performing a bandwidth extension in a bandwidth extension decoder; a core encoder for encoding the low frequency signal to obtain an encoded low frequency signal; and a parameter calculator for calculating bandwidth extension parameters from the high frequency signal.

According to another embodiment, a bandwidth extension decoder for decoding an encoded audio signal, the encoded audio signal having an encoded low frequency signal and upper band parameters, may have a core decoder for decoding the encoded low frequency signal, wherein the decoded low frequency signal has a core frequency band; a patch module which is configured to generate a patched signal based on the decoded low frequency signal and the upper band parameters, wherein the patched signal has an upper frequency band generated from the core frequency band; and a combiner which is configured to combine the patched signal and the decoded low frequency signal to acquire a combined output signal.

According to another embodiment, a phase vocoder processor for processing an audio signal may have an analysis windower for applying a plurality of analysis window functions to the audio signal or a signal derived from the audio signal, the audio signal having a block of audio samples, the block having a specified length in time, to acquire a plurality of windowed audio signals; a time/spectrum converter for converting the windowed audio signals into spectra; a frequency domain processor for processing the spectra in a frequency domain to acquire modified spectra; a frequency/time converter for converting the modified spectra into modified time domain signals; a synthesis windower for applying a plurality of synthesis window functions to the modified time domain signals, wherein the synthesis window functions are matched to the analysis window functions, to acquire windowed modified time domain signals; a comparator which is configured to determine a plurality of comparison parameters based on a comparison of the plurality of windowed modified time domain signals and the audio signal or a signal derived from the audio signal, wherein the plurality of comparison parameters corresponds to the plurality of analysis window functions, and wherein the comparator is furthermore configured to select an analysis window function and a synthesis window function for which a comparison parameter satisfies a predetermined condition; and an overlap adder for adding overlapping blocks of a windowed modified time domain signal to acquire a temporally spreaded signal, wherein the overlap adder is configured for processing blocks of the windowed modified time domain signal having been modified by an analysis window function and a synthesis window function selected by the comparator.

According to another embodiment, a method for encoding an audio signal, the audio signal having a low frequency signal having a core frequency band and a high frequency signal having an upper frequency band, may have the steps of analyzing the audio signal, the audio signal having a block of audio samples, the block having a specified length in time, for determining, from a plurality of analysis windows, an analysis window to be used for performing a bandwidth extension in a bandwidth extension decoder; encoding the low frequency signal to acquire an encoded low frequency signal; and calculating bandwidth extension parameters from the high frequency signal.

According to another embodiment, a method for decoding an encoded audio signal, the encoded audio signal having an encoded low frequency signal and upper band parameters, may have the steps of decoding the encoded low frequency signal, wherein the decoded low frequency signal has a core frequency band; generating a patched signal based on the decoded low frequency signal and the upper band parameters, wherein the patched signal has an upper frequency band generated from the core frequency band; and combining the patched signal and the decoded low frequency signal to acquire a combined output signal.

According to another embodiment, an encoded audio signal may have an encoded low frequency signal; bandwidth extension parameters; and an analysis window to be used for performing a bandwidth extension in a bandwidth extension decoder.

According to another embodiment, a computer program may have a program code for performing one of the above-mentioned methods, when the computer program is executed on a computer.

An idea underlying the present invention is that an improved perceptual quality can be achieved when the audio signal having a block of audio samples with a specified length in time is analyzed in order to determine from a plurality of analysis windows an analysis window to be used for performing a bandwidth extension in a bandwidth extension decoder. By this measure, the reduction of the audio quality resulting from the application of a predetermined analysis window may be prevented and, consequently, the perceptual audio quality may be improved with relatively low efforts as compared to standard BWE methods.

According to an embodiment of the present invention, a bandwidth extension encoder for encoding an audio signal comprises a signal analyzer, a core encoder and a parameter calculator. The audio signal comprises a low frequency signal comprising a core frequency band and a high frequency signal comprising an upper frequency band. The signal analyzer is configured for analyzing the audio signal, the audio signal having a block of audio samples, the block having a specified length in time. The signal analyzer is furthermore configured for determining from a plurality of analysis windows an analysis window to be used for performing a bandwidth extension in a bandwidth extension decoder. The core encoder is configured for encoding the low frequency signal to obtain an encoded low frequency signal. The parameter calculator is configured for calculating bandwidth extension parameters from the high frequency signal.

According to another embodiment of the present invention, a bandwidth extension decoder for decoding an encoded audio signal comprises a core decoder, a patch module and a combiner. The encoded audio signal comprises an encoded low frequency signal and upper band parameters. The core decoder is configured for decoding the encoded low frequency signal, wherein the decoded low frequency signal comprises a core frequency band. The patch module is configured to generate a patched signal based on the decoded low frequency signal and the upper band parameters, wherein the patched signal comprises an upper frequency band generated from the core frequency band. The combiner is configured to combine the patched signal and the decoded low frequency signal to obtain a combined output signal.

According to another embodiment, a phase vocoder processor for processing an audio signal comprises an analysis windower, a time/spectrum converter, a frequency domain processor, a frequency/time converter, a synthesis windower, a comparator and an overlap adder. The analysis windower is configured for applying a plurality of analysis window functions to the audio signal or a signal derived from the audio signal, the audio signal having a block of audio samples, the block having a specified length in time, to obtain a plurality of windowed audio signals. The time/spectrum converter is configured for converting the windowed audio signals into spectra. The frequency domain processor is configured for processing the spectra in a frequency domain to obtain modified spectra. The frequency/time converter is configured for converting the modified spectra into modified time domain signals. The synthesis windower is configured for applying a plurality of synthesis window functions to the modified time domain signals, wherein the synthesis window functions are matched to the analysis window functions, to obtain windowed modified time domain signals. The comparator is configured to determine a plurality of comparison parameters based on a comparison of the plurality of windowed modified time domain signals and the audio signal or a signal derived from the audio signal, wherein the plurality of comparison parameters corresponds to the plurality of analysis window functions. The comparator is furthermore configured to select an analysis window function and a synthesis window function for which a comparison parameter satisfies a predetermined condition. The overlap adder is configured for adding overlapping blocks of a windowed modified time domain signal to obtain a temporally spread signal. The overlap adder is furthermore configured for processing blocks of the windowed modified time domain signal having been modified by an analysis window function and a synthesis window function selected by the comparator.

Embodiments of the present invention are based on the concept that a plurality of patched signals may be generated from a plurality of analysis window functions applied to the audio signal comprising the core frequency band. The plurality of patched signals may be compared with a reference signal being the original audio signal or a signal derived from the audio signal. This will result in a plurality of comparison parameters, which may be related to measures of the audio quality. Furthermore, from the plurality of analysis window functions, an analysis window function may be selected for which a comparison parameter satisfies a predetermined condition. Therefore, the use of the selected analysis window function may ensure minimal reduction of the audio quality, leading to optimal perceptual audio quality in the context of a BWE scenario.

Other embodiments of the present invention relate to a signal analyzer comprising a signal classifier, wherein the signal classifier is configured to analyze/classify the audio signal or a signal derived from the audio signal. In this case, the analysis window function to be used for performing a bandwidth extension in the bandwidth extension decoder is selected based on a signal characteristic of the analyzed/classified signal.

Therefore, embodiments provide a method of selecting the optimal analysis window for the bandwidth extension in the decoder. Control parameters may be evaluated in order to decide which analysis window is the most appropriate. To achieve this, an analysis-by-synthesis scheme may be used; i.e. a set of windows may be applied and the best according to a suitable objective is chosen. In the advantageous mode of the invention, the objective is to ensure optimal perceptual audio quality of the restitution. In alternative modes, an objective function may be optimized. For example, the objective may be to preserve the spectral flatness of the original HF as close as possible.

On the one hand, the window selection can be done only at the encoder by considering the original signal, the synthesized signal or both of them. A decision (window indication) is then transmitted to the decoder. On the other hand, the selection may be performed synchronously at the encoder and the decoder side considering only the core bandwidth of the decoded signal. The latter method is not in need to generate additional side information, which is favorable in terms of bitrate efficiency of the codec.

The invention is advantageous in that it optimizes the perceptual quality of the vocoder output signal. Embodiments provide a signal adaptive choosing of appropriate analysis and synthesis windows for the vocoding process, wherein different time responses or frequency responses of the analysis and/or synthesis windows are possible.

Another advantage of the invention is that it enables a better trade-off between reduction of the above-mentioned degradation and the computational complexity such as within a BWE scheme.

BRIEF DESCRIPTION OF THE DRAWINGS

In the following, embodiments of the present invention are explained with reference to the accompanying drawings, in which.

DETAILED DESCRIPTION OF THE INVENTION

Figure 1:
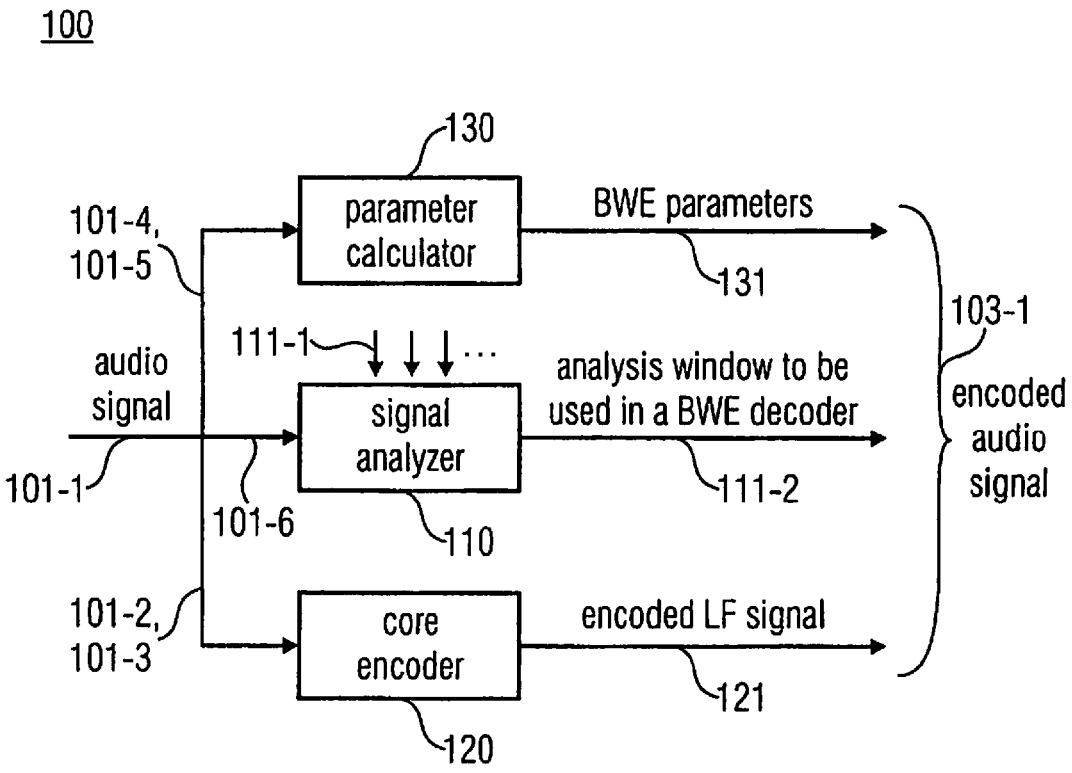
FIG. 1 shows a block diagram of an embodiment of a bandwidth extension encoder.

FIG. 1 shows a block diagram of a bandwidth extension encoder 100 for encoding an audio signal 101-1 according to an embodiment of the present invention. The audio signal 101-1 comprises a low frequency signal 101-2 comprising a core frequency band 101-3 and a high frequency signal 101-4 comprising an upper frequency band 101-5. The bandwidth extension encoder 100 comprises a signal analyzer 110, a core encoder 120 and a parameter calculator 130. The signal analyzer 110 is configured for analyzing the audio signal 101-1, the audio signal 101-1 having a block 101-6 of audio samples, the block 101-6 having a specified length in time. The signal analyzer 110 is furthermore configured for determining from a plurality 111-1 of analysis windows an analysis window 111-2 to be used for performing a bandwidth extension such as in the bandwidth extension decoder 200. The core encoder 120 is configured for encoding the low frequency signal 101-2 to obtain an encoded low frequency signal 121. Finally, the parameter calculator 130 is configured for calculating bandwidth extension parameters 131 from the high frequency signal 101-4. The bandwidth extension parameters 131, the analysis window 111-2 to be used in the bandwidth extension decoder 200 and the encoded low frequency signal 121 constitute an encoded audio signal 103-1 provided by the bandwidth extension encoder 100.

Figure 2:
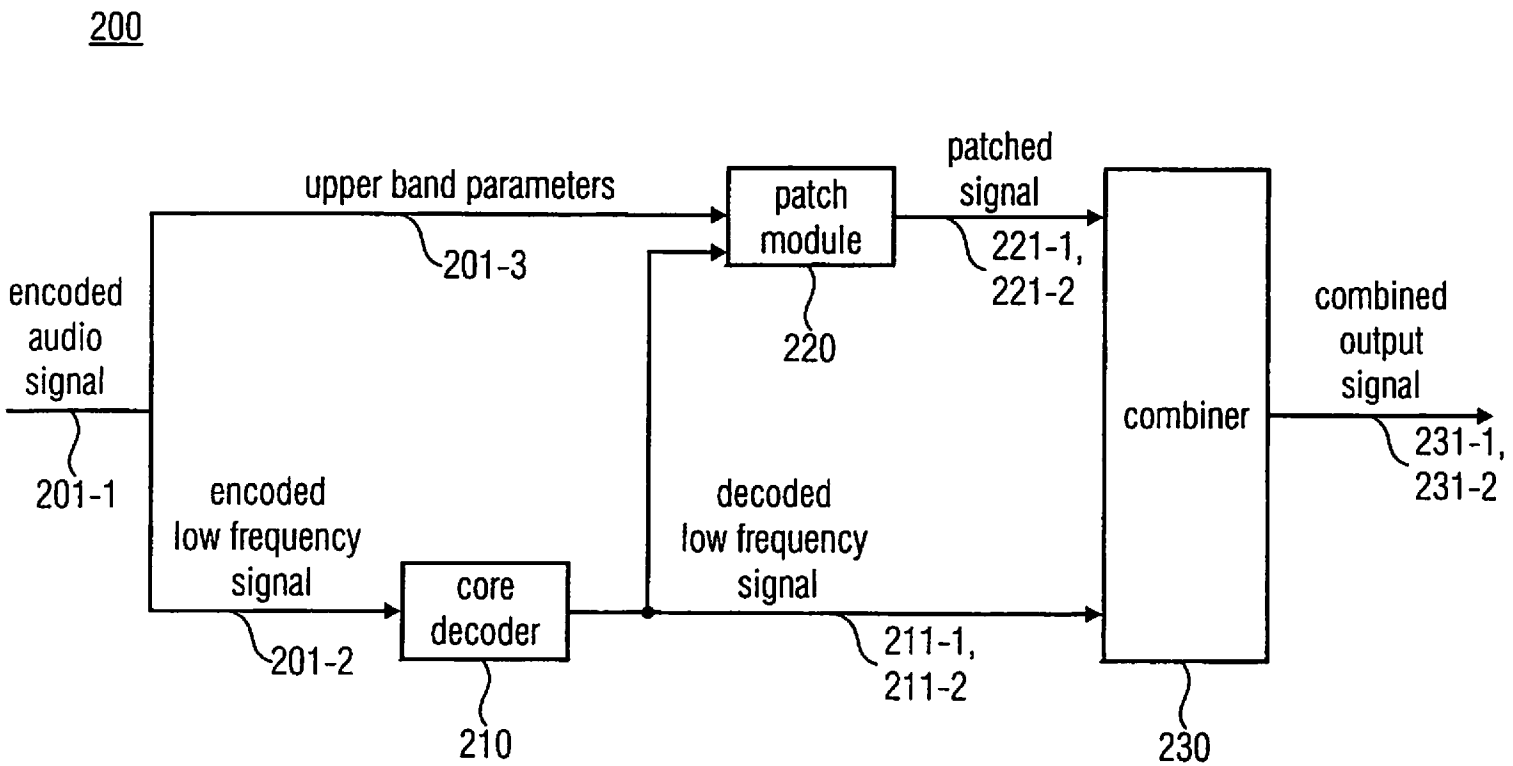
FIG. 2 shows a block diagram of an embodiment of a bandwidth extension decoder.

FIG. 2 shows a block diagram of a bandwidth extension decoder 200 for decoding an encoded audio signal 201-1 according to another embodiment of the present invention. The encoded audio signal 201-1 comprises an encoded low frequency signal 201-2 and upper band parameters 201-3. Here, the encoded audio signal 201-1 may correspond to the encoded audio signal 103-1 as provided by the bandwidth extension encoder 100 shown in FIG. 1. The bandwidth extension decoder 200 comprises a core decoder 210, a patch module 220 and a combiner 230. The core decoder 210 is configured for decoding the encoded low frequency signal 201-2 to obtain a decoded low frequency signal 211-1. The decoded low frequency signal 211-1 comprises a core frequency band 211-2. The patch module 220 is configured to generate a patched signal 221-1 based on the decoded low frequency signal 211-1 and the upper band parameters 201-3, wherein the patched signal 221-1 comprises an upper frequency band 221-2 generated from the core frequency band 211-2. Finally, the combiner 230 is configured to combine the patched signal 221-1 and the decoded low frequency signal 211-1 to obtain a combined output signal 231-1. In particular, the patched signal 221-1 may be a signal in a target frequency range of a bandwidth extension algorithm, while the combined output signal 231-1 provided by the bandwidth extension decoder 200 may be a manipulated signal with an extended bandwidth (231-2).

Figure 3:
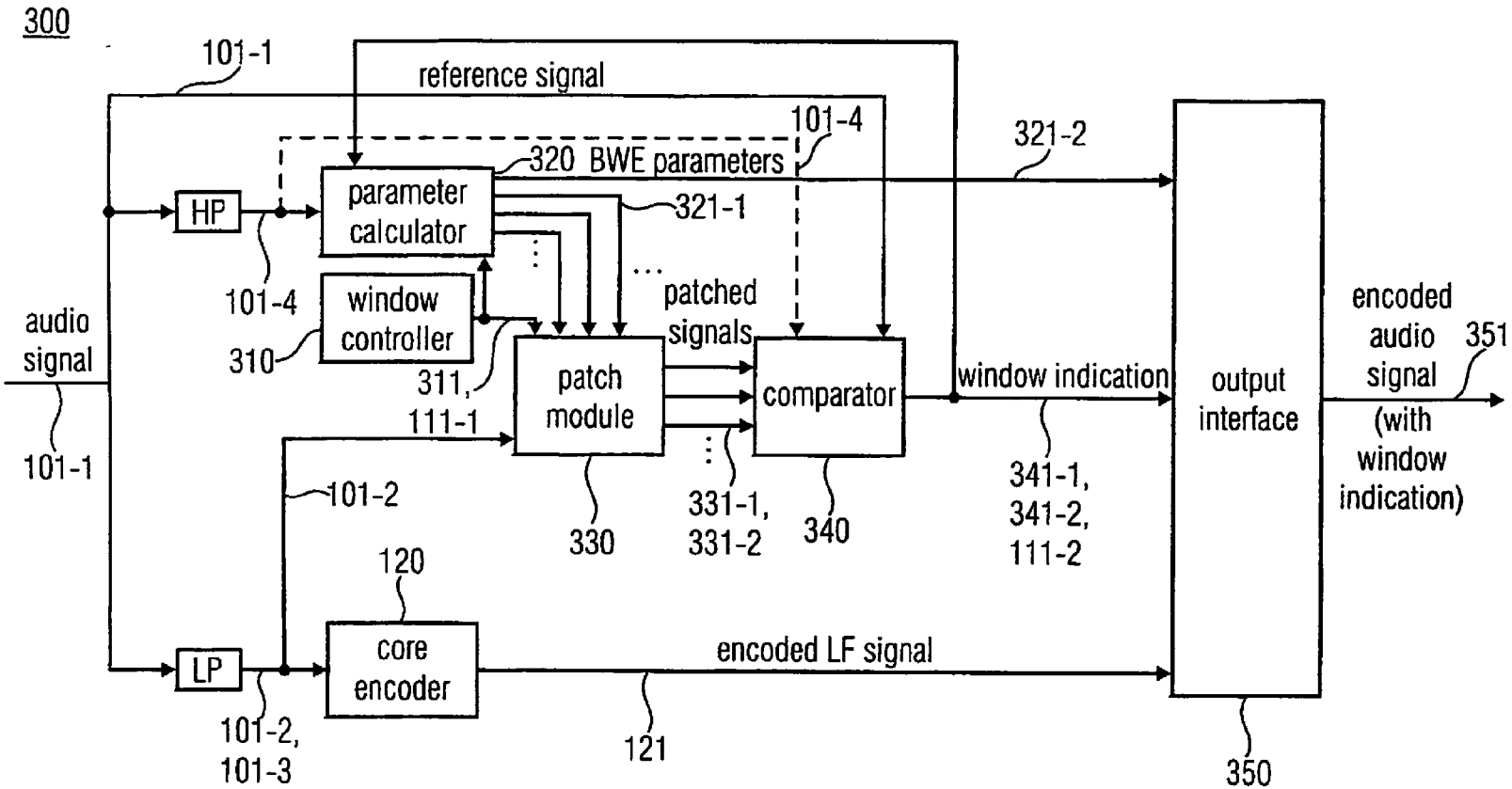
FIG. 3 shows a block diagram of a further embodiment of a bandwidth extension encoder.

FIG. 3 shows a block diagram of a further embodiment of a bandwidth extension encoder 300. The bandwidth extension encoder 300 may comprise a low pass (LP) filter and a high pass (HP) filter. The filters may be implemented to generate a low pass filtered version of the audio signal 101-1 being the low frequency signal 101-2 and a high pass filtered version of the audio signal 101-1 being the high frequency signal 101-4. As shown in FIG. 3, the bandwidth extension encoder 300 may further comprise a window controller 310 for providing window control information 311 to be used by a parameter calculator 320 and a patch module 330. The window control information 311 provided by the window controller 310 may indicate a plurality 111-1 of analysis window functions to be applied to the block 101-6 of audio samples derived from the audio signal 101-1. The parameter calculator 320, in particular, may comprise a windower controlled by the window controller 310, wherein the windower of the parameter calculator 320 is configured to apply the plurality 111-1 of analysis window functions and an analysis window function 111-2 to be selected by a comparator 340 to the high frequency signal 101-4. Here, bandwidth extension parameters 321-1, 321-2 corresponding to the plurality 111-1 of analysis window functions as indicated by the window control information 311 and corresponding to the selected analysis window function 111-2 as provided by a window indication 340-1 at the output of the comparator 340 are obtained, respectively.

In the embodiment shown in FIG. 3, the signal analyzer 110 comprises a patch module 330, which is configured to generate a plurality 331-1 of patched signals based on the low frequency signal 101-2, the window control information 311 and the bandwidth extension parameters 321-1. Here, the patched signals 331-1 comprise upper frequency bands 331-2 generated from the core frequency band 101-3. The patch module 330, in particular, comprises a windower controlled by the window controller 310, wherein the windower of the patch module 330 is configured for applying the plurality 111-1 of analysis window functions to the low frequency signal 101-2.

Furthermore, the signal analyzer 110 of the bandwidth extension encoder 300 comprises a comparator 340, which is configured to determine a plurality 341-2 of comparison parameters based on a comparison of the patched signals 331-1 and a reference signal being the audio signal 101-1 or a signal derived from the audio signal such as the high frequency signal 101-4 indicated by the dashed line, wherein the plurality 341-2 of comparison parameters corresponds to the plurality 111-1 of analysis window functions. The comparator 340 is furthermore configured to provide a window indication 341-1 corresponding to an analysis window function 111-2, for which a comparison parameter satisfies a predetermined condition. Finally, the bandwidth extension encoder 300 comprises an output interface 350 for providing an encoded audio signal 351, the encoded audio signal 351 comprising the window indication 341-1.

Figure 7:
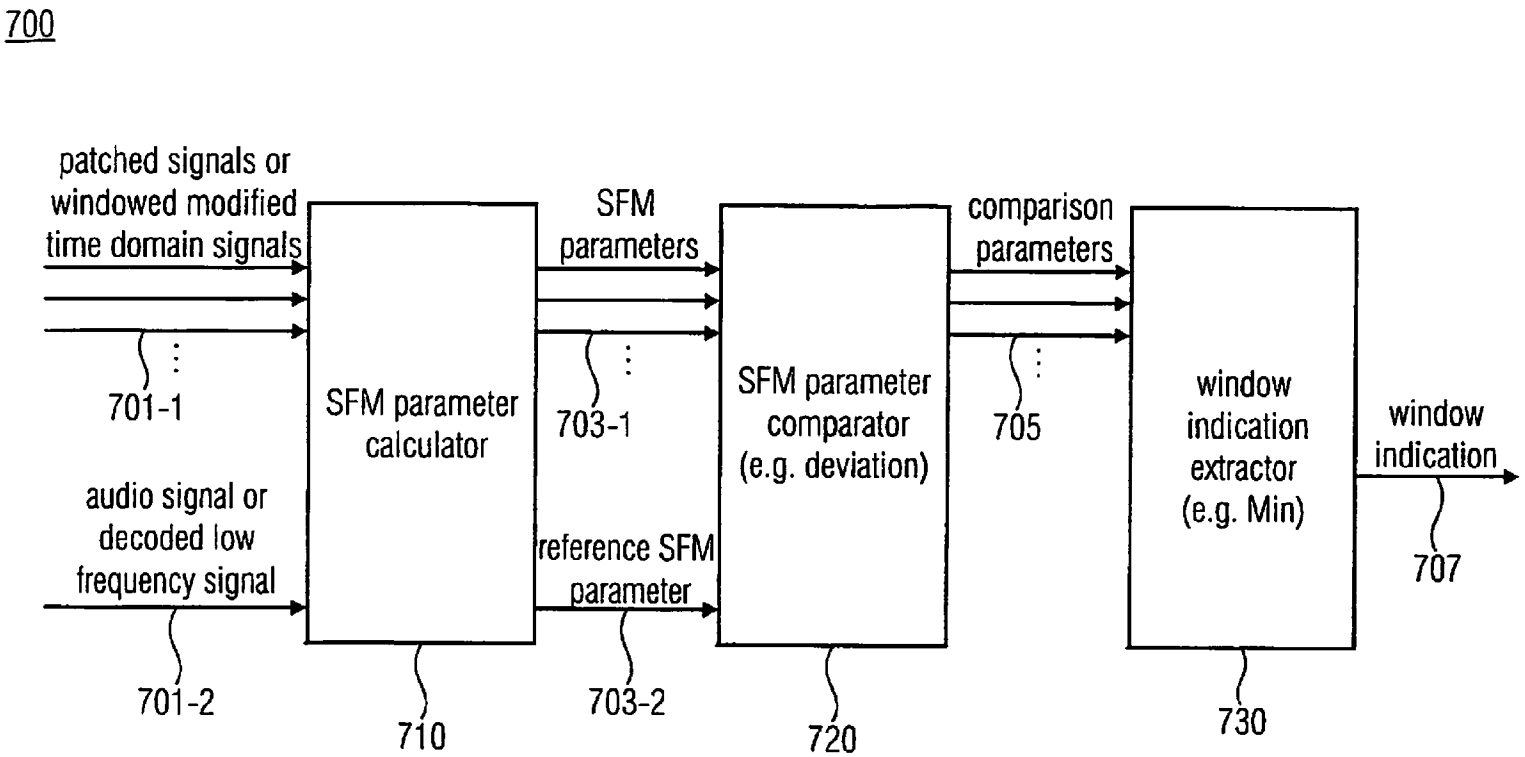
FIG. 7 shows a block diagram of an implementation of a comparator.

With regard to an implementation of the above comparison, FIG. 7 shows a block diagram of an embodiment of a comparator 700, which may comprise a spectral flatness measure (SFM) parameter calculator 710, an SFM parameter comparator 720 and a window indication extractor 730. The SFM parameter calculator 710 may be implemented to calculate, for example, a plurality 703-1 of SFM parameters from a plurality 701-1 of input signals and a reference SFM parameter 703-2 from a reference input signal 701-2. In particular, each SFM parameter may be calculated by dividing the geometric mean of the power spectrum by the arithmetic mean of the power spectrum derived from the corresponding input signal, wherein a relatively high SFM parameter indicates that the spectrum has a similar amount of power in all spectral bands, while a relatively low SFM parameter indicates that the spectral power is concentrated in a relatively small number of bands. In addition, the SFM parameter can also be measured within a certain partial band (subband) rather than across the whole band of the input signal. The SFM parameter comparator 720 may be implemented to compare the SFM parameters 703-1 with the reference SFM parameter 703-2 to obtain a plurality 705 of comparison parameters, wherein the comparison parameters 705 may, for example, be based on the deviations in the compared SFM parameters. The window indication extractor 730 may be implemented to select, from the plurality of comparison parameters 705, a comparison parameter, for which a predetermined condition will be satisfied. The predetermined condition may, for example, be chosen such that the selected comparison parameter will be a minimum of the plurality of comparison parameters 705. In this case, the selected comparison parameter will correspond to an input signal from the plurality of input signals 701-1, which is characterized by a minimum deviation from the reference input signal 701-2 in terms of spectral flatness.

Specifically, the input signals 701-1 may correspond to the patched signals 331-1, the patched signals 331-1 having been obtained after applying the plurality 111-1 of analysis window functions to the audio signal 101-1 or a signal derived from the audio signal 101-1 such as the low frequency signal 101-2, while the reference input signal 701-2 may correspond to the original audio signal 101-1. Furthermore, the plurality 705 of comparison parameters of the comparator 700 may correspond to the plurality 341-2 of comparison parameters of the bandwidth extension encoder 300. Therefore, an analysis window function 111-2 may be selected corresponding to the selected comparison parameter in that a deviation in the SFM parameters of the patched signals 331-1 and the original audio signal 101-1, for example, will be minimal. The selected analysis window function 111-2 may also be referenced to by a window indication 707, which may correspond to the window indication 341-1, provided at the output of the comparator 700 or the comparator 340, respectively. Consequently, the perceptual audio quality as measured by a spectral flatness, for example, will be changed or reduced as less as possible when the selected analysis window function 111-2 is chosen for performing a bandwidth extension such as within a bandwidth extension decoder.

Moreover, the plurality 111-1 of analysis window functions indicated by the window control information 311 at the output of the window controller 310 may comprise different analysis window functions having different window characteristics having the same window length as the block 101-6 in time. In particular, the different analysis window functions may be characterized by different frequency response functions ("transfer functions") obtained from a spectral analysis. The transfer functions, in turn, can be distinguished by characteristic features such as their main lobe widths, side lobe levels or side lobe fall-offs. The different analysis window functions may also be divided into several groups with regard to their performance characteristics such as spectral resolution or dynamic range. For example, high and moderate resolution windows may be represented by rectangular, triangular, cosine, raised-cosine, Hamming, Hann, Bartlett, Blackman, Gaussian, Kaiser or Bartlett-Hann window functions, while low resolution or high dynamic range windows may be represented by flat-top, Blackman-Harris or Tukey window functions. In alternative embodiments, it may also be possible to use window functions having a different number of samples (i.e. windows of different window lengths).

Specifically, applying different analysis window functions 111-1, which may belong to different groups of analysis window functions, to the block 101-6 of audio samples by the use of the patch module 330, for example, will result in patched signals 331-1 having different characteristic features such as different SFM parameters.

Figure 4:
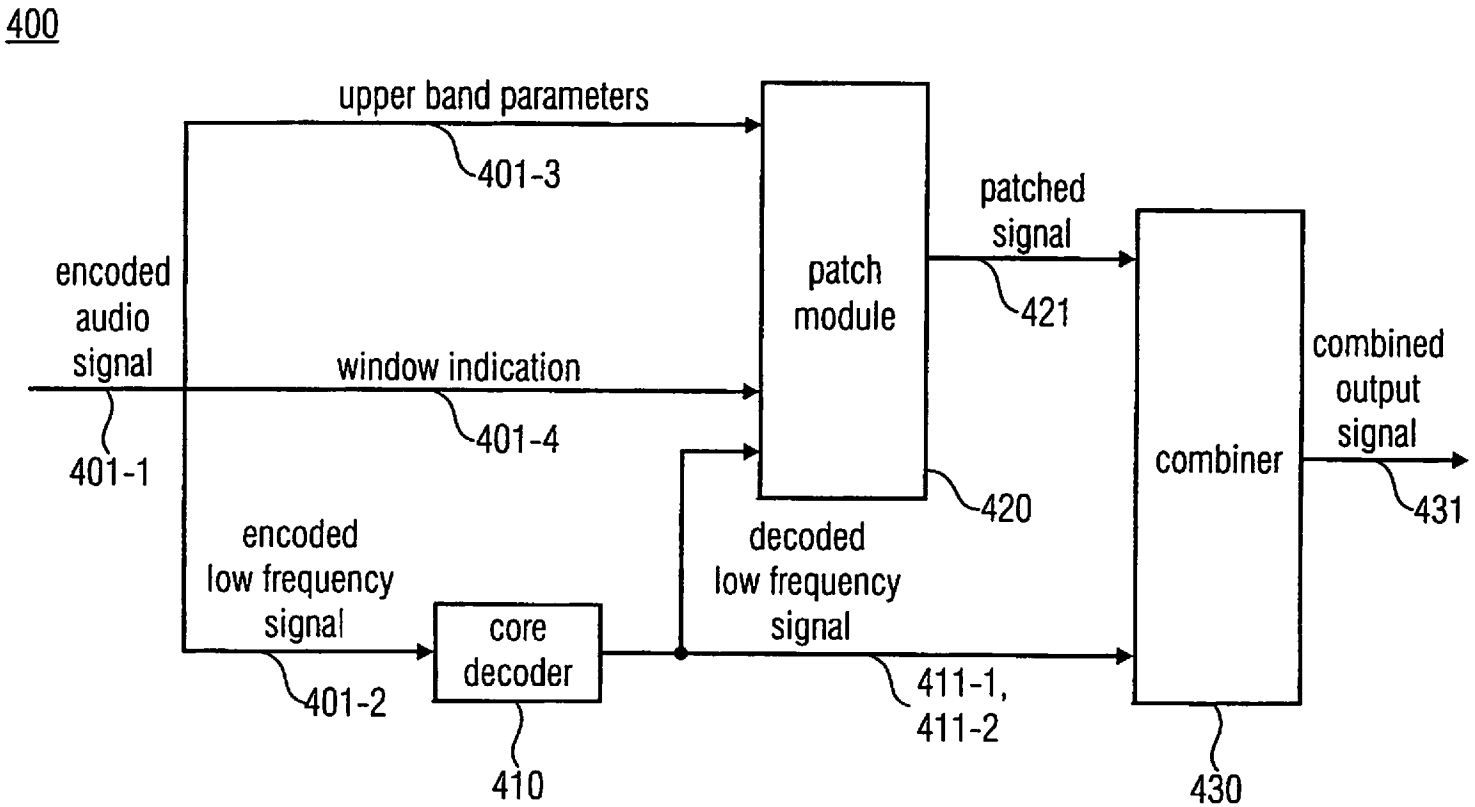
FIG. 4 shows a block diagram of a further embodiment of a bandwidth extension decoder.

FIG. 4 shows a block diagram of a further embodiment of a bandwidth extension decoder 400, which can explicitly make use of the window indication 341-1 as provided, for example, by the bandwidth extension encoder 300 shown in FIG. 3. The bandwidth extension decoder 400, in particular, is implemented to be operative on an encoded audio signal 401-1 comprising, besides an encoded low frequency signal 401-2 and upper band parameters 401-3, a window indication 401-4. Here, the encoded low frequency signal 401-2, the upper band parameters 401-3 and the window indication 401-4 may correspond to the encoded low frequency signal 121, the bandwidth extension parameters 321-2 and the window indication 341-1 output from the output interface 350 of the bandwidth extension encoder 300, respectively. In the embodiment shown in FIG. 4, the bandwidth extension decoder 400 comprises a core decoder 410, which may correspond to the core decoder 210 of the bandwidth extension decoder 200, the core decoder 410 being configured for decoding the encoded low frequency signal 401-2, wherein the decoded low frequency signal 411-1 comprises a core frequency band 411-2. Furthermore, the bandwidth extension decoder 400 comprises a patch module 420, which may correspond to the patch module 220 of the bandwidth extension decoder 200, wherein the patch module 420 comprises a controllable windower for selecting an analysis window function from a plurality of analysis window functions based on the window indication 401-4 and for applying the selected analysis window function to the decoded low frequency signal 411-1. In this way, a patched signal 421 will be obtained at the output of the patch module 420. The patched signal 421 may further be combined with the low frequency signal 411-1 by a combiner 430 such that a combined output signal 431 will be output from the bandwidth extension decoder 400. Here, the patched signal 421, the decoded low frequency signal 411-1, the combiner 430 and the combined output signal 431 may correspond to the patched signal 221-1, the decoded low frequency signal 211-1, the combiner 230 and the combined output signal 231-1, respectively. As before, the combined output signal 431 may be a manipulated signal with an extended bandwidth.

With regard to FIGS. 3 and 4, it may be advantageous that the window indication 341-1; 401-4 corresponding to an optimum analysis window function having been obtained with a signal analysis on the encoder side (FIG. 3), can be transmitted within the encoded audio signal 351; 401-1 and subsequently be used by the patch module 420 such that a bandwidth extension can be performed without needing a further signal analysis on the decoder side (FIG. 4).

Figure 5:
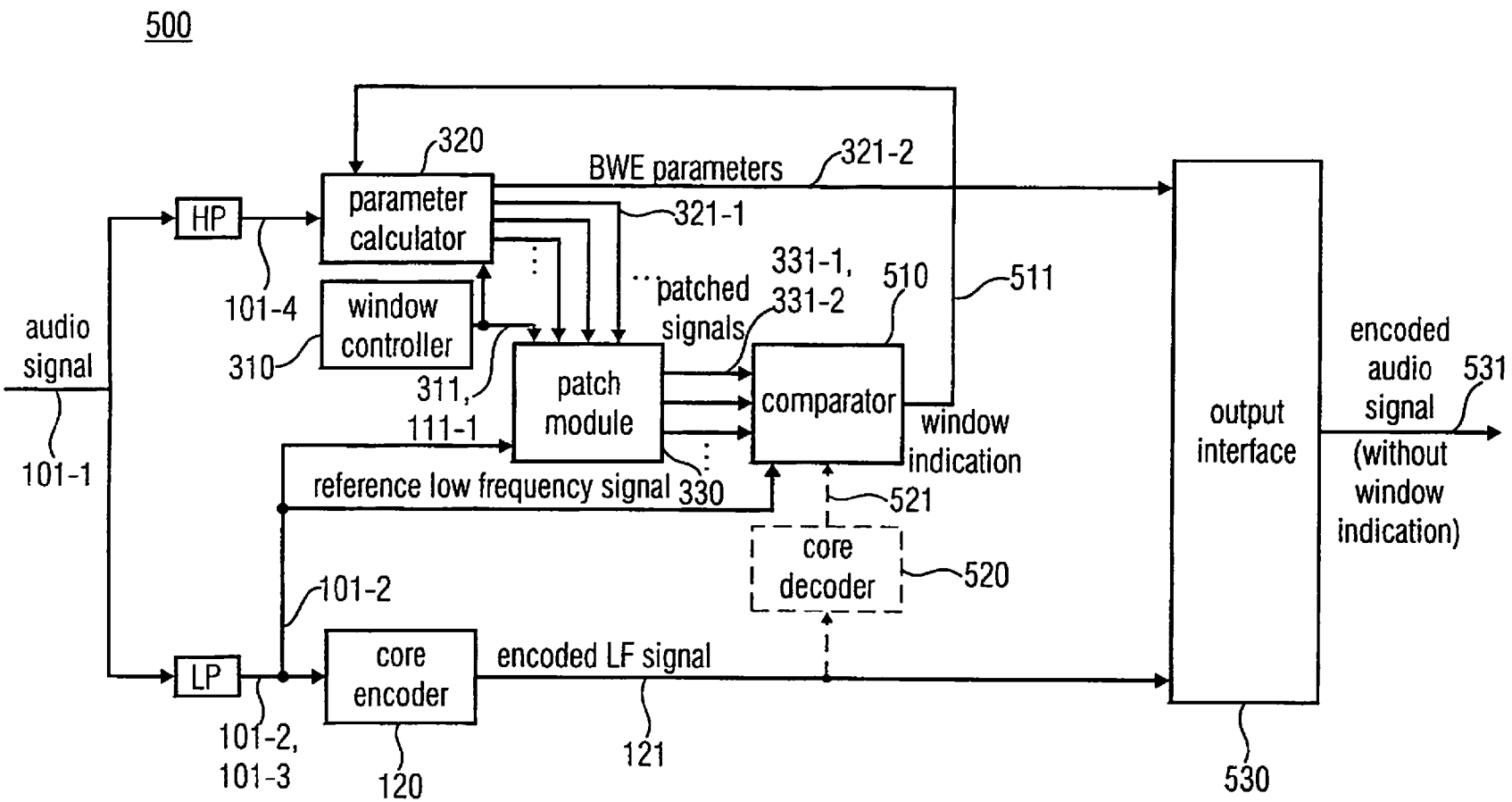
FIG. 5 shows a block diagram of a further embodiment of a bandwidth extension encoder.

FIG. 5 shows a block diagram of a further embodiment of a bandwidth extension encoder 500. The bandwidth extension encoder 500 essentially comprises the same blocks as the bandwidth extension encoder 300 in FIG. 3. Therefore, identical blocks having similar implementations and/or functions are denoted by the same numerals. However, contrary to the embodiment shown in FIG. 3, the bandwidth extension encoder 500 comprises a comparator 510, which is configured to compare the plurality of patched signals 333-1 with a reference low frequency signal derived from the audio signal 101-1. The bandwidth extension encoder 500 may optionally also comprise a core decoder 520, which is implemented to provide a decoded low frequency signal 521 by decoding the encoded low frequency signal 121 from the output of the core encoder 120. For the reference low frequency signal, for example, the low frequency signal 101-2 being a low pass filtered version of the audio signal 101-1 or the decoded low frequency signal 521 from the output of the core decoder 520, may be used. Furthermore, the comparator 510 is configured to provide a window indication 511 corresponding to a selected (optimum) analysis window function, wherein, in this case, the window selection is based on the comparison of the patched signals 331-1 with the reference low frequency signal 101-2 or 521. As with the window indication 341-1 in the embodiment shown in FIG. 3, the window indication 511 can be supplied to the parameter calculator 320 such that only the BWE parameters 321-2 corresponding to the window indication 511 will be obtained. The BWE parameters 321-2, together with the encoded low frequency signal 121, may be supplied to an output interface 530. Here, the window indication 511, however, may not be supplied to the output interface 530. Finally, the output interface 530 is configured for providing an encoded audio signal 531, the encoded audio signal 531 not comprising the window indication 511.

Figure 6:
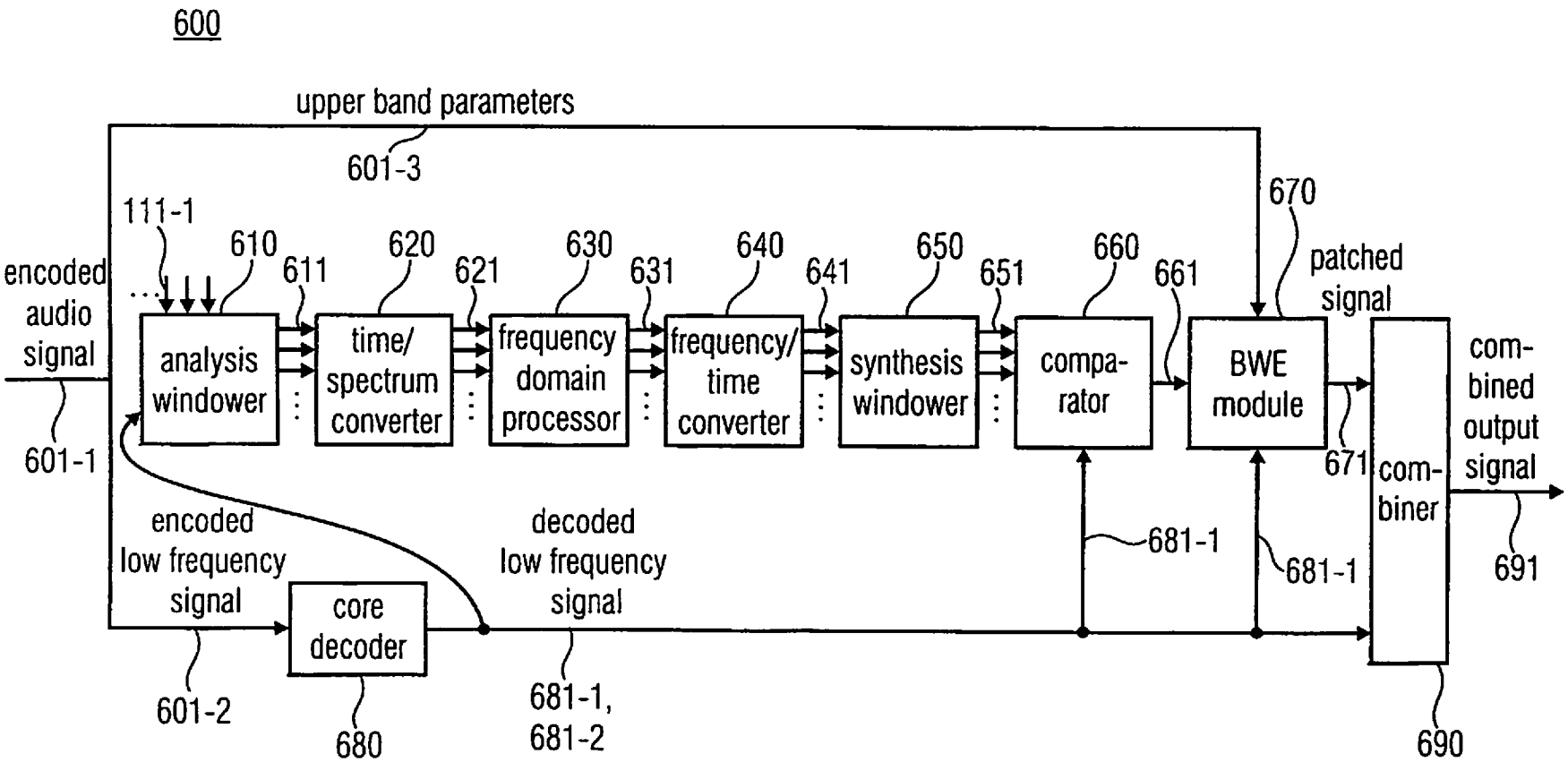
FIG. 6 shows a block diagram of a further embodiment of a bandwidth extension decoder.

FIG. 6 shows a block diagram of a further embodiment of a bandwidth extension decoder 600. The bandwidth extension decoder 600, in particular, is implemented to be operative on an encoded audio signal 601-1 comprising an encoded low frequency signal 601-2 and upper band parameters 601-3. Here, the encoded audio signal 601-1, the encoded low frequency signal 601-2 and the upper band parameters 601-3 may correspond to the encoded audio signal 201-1, the encoded low frequency signal 201-2 and the upper band parameters 201-3, respectively. Especially in the embodiment shown in FIG. 6, the encoded audio signal 601-1, which is fed into the bandwidth extension decoder 600, does not comprise a window indication. For this reason, a signal analysis with the objective of selecting an appropriate window function to be applied such as within a bandwidth extension scheme is needed on the decoder side in this case (FIG. 6).

As shown in FIG. 6, the patch module 220 of the bandwidth extension decoder 600 comprises an analysis windower 610, a time/spectrum converter 620, a frequency domain processor 630, a frequency/time converter 640, a synthesis windower 650, a comparator 660 and a bandwidth extension module 670. In addition, the bandwidth extension decoder 600 comprises a core decoder 680 for decoding the encoded low frequency signal 601-2, wherein the decoded low frequency signal 681-1 comprises a core frequency band 681-2. Here, the core decoder 680 and the decoded low frequency signal 681-1 may correspond to the core decoder 210 and the decoded low frequency signal 211-1, respectively.

The analysis windower 610 is configured for applying a plurality of analysis window functions such as the analysis window functions 111-1 in the embodiments of the bandwidth extension encoders 300; 500 to the decoded low frequency signal 681-1 to obtain a plurality 611 of windowed low frequency signals. The time/spectrum converter 620 is configured for converting the windowed low frequency signals 611 into spectra 621. The frequency domain processor 630 is configured for processing the spectra 621 in a frequency domain to obtain modified spectra 631. The frequency/time converter 640 is configured for converting the modified spectra 631 into modified time domain signals 641. The synthesis windower 650 is configured for applying a plurality of synthesis window functions to the modified time domain signals 641, wherein the synthesis window functions are matched to the analysis window functions, to obtain windowed modified time domain signals 651. In particular, the synthesis window functions can be matched to the analysis window functions such that applying the synthesis window functions will compensate for the effect of the corresponding analysis window functions. The comparator 660 is configured to determine a plurality of comparison parameters based on a comparison of the plurality 651 of windowed modified time domain signals and the decoded low frequency signal 681-1, wherein the plurality of comparison parameters corresponds to the plurality 111-1 of analysis window functions having been applied to the decoded low frequency signal 681-1 by the analysis windower 610. The comparator 660 is furthermore configured to select an analysis window function and a synthesis window function for which a comparison parameter satisfies a predetermined condition. Here, the comparator 660 may especially be configured as discussed before in the context of FIG. 7. The selected analysis window function and synthesis window function may constitute a window indication 661 provided at the output of the comparator 660. However, opposed to the embodiment of the bandwidth extension decoder 400 shown in FIG. 4, wherein the window indication 401-4 used for performing a bandwidth extension on the decoder side is contained in the encoded audio signal 401-1, the window indication 661 of the bandwidth extension decoder 600 shown in FIG. 6 is not available in the encoded audio signal 601-1 such that the window indication 661 has to be determined from analyzing the decoded low frequency signal 681-1 derived from the encoded audio signal 601-1 first. Furthermore, the patch module 220 of the bandwidth extension decoder 600 may comprise a bandwidth extension module 670, which is configured to carry out a bandwidth extension algorithm in that the patch module 220 will generate a patched signal 671 based on the decoded low frequency signal 681-1, the analysis window function and the synthesis window function selected by the comparator 660 and the upper band parameter 601-3. Finally, the patched signals 671 and the decoded low frequency signal 681-1 may be combined by a combiner 690 to obtain a combined output signal 691 having an extended bandwidth. Here, the patched signal 671, the decoded low frequency signal 681-1, the combiner 690 and the combined output signal 691 may correspond to the patched signal 221-1, the decoded low frequency signal 211-1, the combiner 230 and the combined output signal 231-1 of the bandwidth extension decoder 200 shown in FIG. 2, respectively.

In the embodiments of the bandwidth extension encoders/decoders presented before, the employed comparators may correspond to the comparator 700 as described in FIG. 7. Specifically, the comparator 700 may be implemented to receive, as the plurality of input signals 701-1, the plurality 331-1 of patched signals of the bandwidth extension encoders 300 and 500 in FIGS. 3 and 5 or the plurality 651 of windowed modified time domain signals of the bandwidth extension decoder 600 in FIG. 6 and, as the reference input signal 701-2, the audio signal 101-1 denoted by 'reference signal' in FIG. 3 or the high frequency signal 101-4 indicated by the dashed line in FIG. 3, the low frequency signal 101-2 denoted by 'reference low frequency signal' in FIG. 5 or the decoded low frequency signal 521 indicated by the dashed line in FIG. 5 or the decoded low frequency signal 681-1 of the bandwidth extension decoder 600 in FIG. 6. The comparator 700 is furthermore configured to provide the window indication 707, which may correspond to the window indication 341-1 of the bandwidth extension encoder 300 in FIG. 3, the window indication 511 of the bandwidth extension encoder 500 in FIG. 5 or the window indication 661 of the bandwidth extension decoder 600 in FIG. 6. As discussed before, the comparison may, for example, be based on a calculation of the SFM parameters of the input signals. Alternatively, the input signals 701-1 may also be compared with the reference input signals 701-2 based on a sample-wise calculation of the differences in their audio signal values.

In the previous embodiments, the window selection is performed by a signal analysis in that a plurality of different analysis window functions is applied to the audio signal or a signal derived from the audio signal, generating a plurality of different patched (synthesized) signals. From this plurality of synthesized signals, an optimum window function is selected based on a predefined criterion based on a comparison of the synthesized signals with the original audio signal or a signal derived from the audio signal. The selected window function is then applied to the audio signal or a signal derived from the audio signal such as within a bandwidth extension scheme so that a specific patched (synthesized) signal will be generated. The above procedure, in particular, corresponds to a closed loop and can be referred to as an 'analysis-by-synthesis' scheme. Alternatively, the window selection can also be performed by a direct analysis of an input signal being the audio signal or a signal derived from the audio signal, wherein the original input signal is analyzed/classified with regard to a certain signal characteristic such as a measure of the tonality. This alternative analysis scheme corresponding to an open loop will be presented in the following embodiments.

Figure 8:
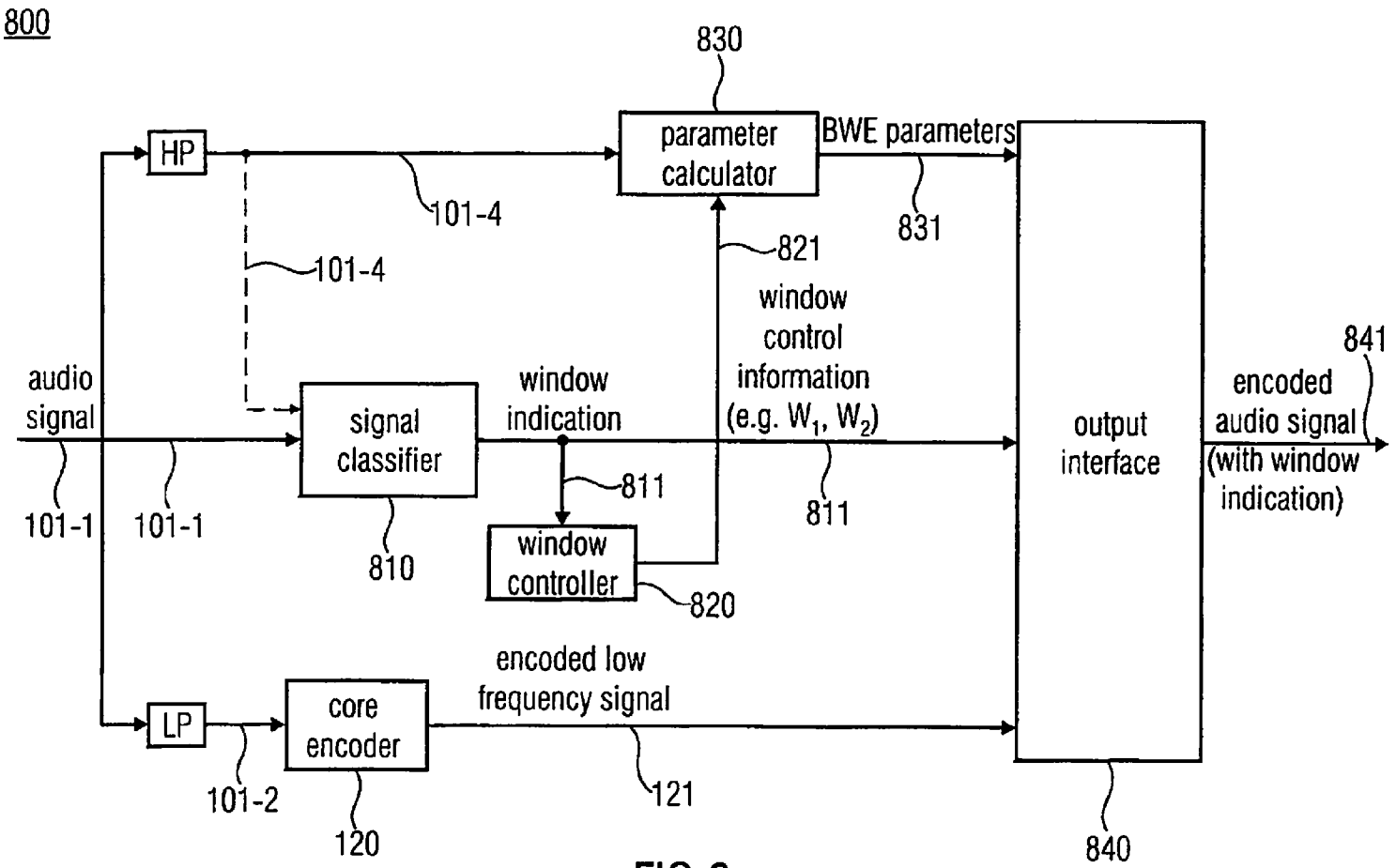
FIG. 8 shows a block diagram of a further embodiment of a bandwidth extension encoder.

FIG. 8 shows a block diagram of a further embodiment of a bandwidth extension encoder 800. Here, the basic structure of the bandwidth extension encoder 800 corresponds to that of the bandwidth extension encoder 300 shown in FIG. 3. Therefore, identical blocks shown in FIGS. 3 and 8 may be denoted by the same numerals.

The signal analyzer 110 of the bandwidth extension encoder 800 comprises a signal classifier 810, wherein the signal classifier 810 is configured to classify the audio signal

101-1 or a signal derived from the audio signal such as the high frequency signal 101-4 (dashed line) for determining a window indication 811 corresponding to an analysis window function based on a signal characteristic of the classified signal. For example, the signal classifier 810 may be implemented to determine the window indication 811 by calculating a tonality measure from the audio signal 101-1 or the high frequency signal 101-4, wherein the tonality measure may indicate how the spectral energy is distributed in their bands. In case the spectral energy is distributed relatively uniformly in a band, a rather non-tonal signal ('noisy signal') exists in this band and the window indication 811 may be related to a first window function having a first characteristic adapted to be applied to the non-tonal signal, while in case the spectral energy is relatively strongly concentrated at a certain location in this band, a rather tonal signal exists for this band and the window indication 811 may be related to a second window function having a second characteristic adapted to be applied to the tonal signal. Furthermore, the encoder 800 comprises a window controller 820 for providing window control information 821 based on the window indication 811 determined by the signal classifier 810. The parameter calculator 830 of the encoder 800 comprises a windower controlled by the window controller 820, wherein the windower of the parameter calculator 830 is configured to apply an analysis window function based on the window control information 821 to the high frequency signal 101-4 to obtain BWE parameters 831. The window controller 820 may, for example, be implemented to provide the window control information 821 for the parameter calculator 830 so that a first window characterized by a transfer function with a first width of a main lobe will be applied by the windower of the parameter calculator 830, when the determined tonality measure is below a predefined threshold, or a second window characterized by a transfer function with a second width of a main lobe will be applied by the windower of the parameter calculator 830, when the determined tonality measure is equal or above the predefined threshold, wherein the first width of the main lobe of the transfer function is larger than the second width of the main lobe of the transfer function. In particular, in the context of a bandwidth extension scheme, it may be advantageous to use a window function having a rather large main lobe of the transfer function in case of a non-tonal signal and a rather small main lobe of the transfer function in case of a tonal signal.

The core encoder 120 of the bandwidth extension encoder 800 is configured to encode the low frequency signal 101-2 to obtain an encoded low frequency signal 121. As in the embodiment shown in FIG. 3, the encoded low frequency signal 121, the window indication 811 and the BWE parameters 831 may be supplied to an output interface 840 for providing an encoded audio signal 841 comprising the window indication 811.

Figure 9:
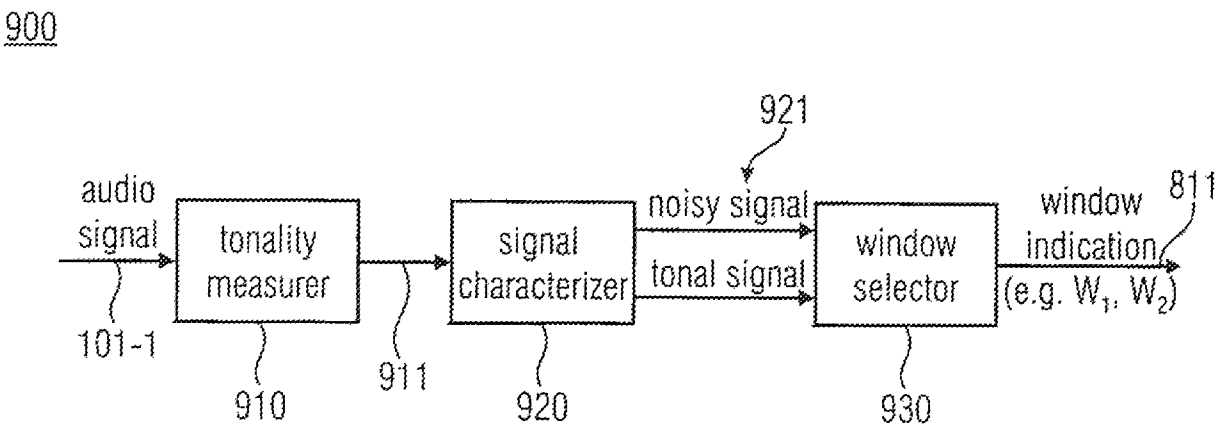
FIG. 9 shows a block diagram of an implementation of a signal classifier.
Figure 10:
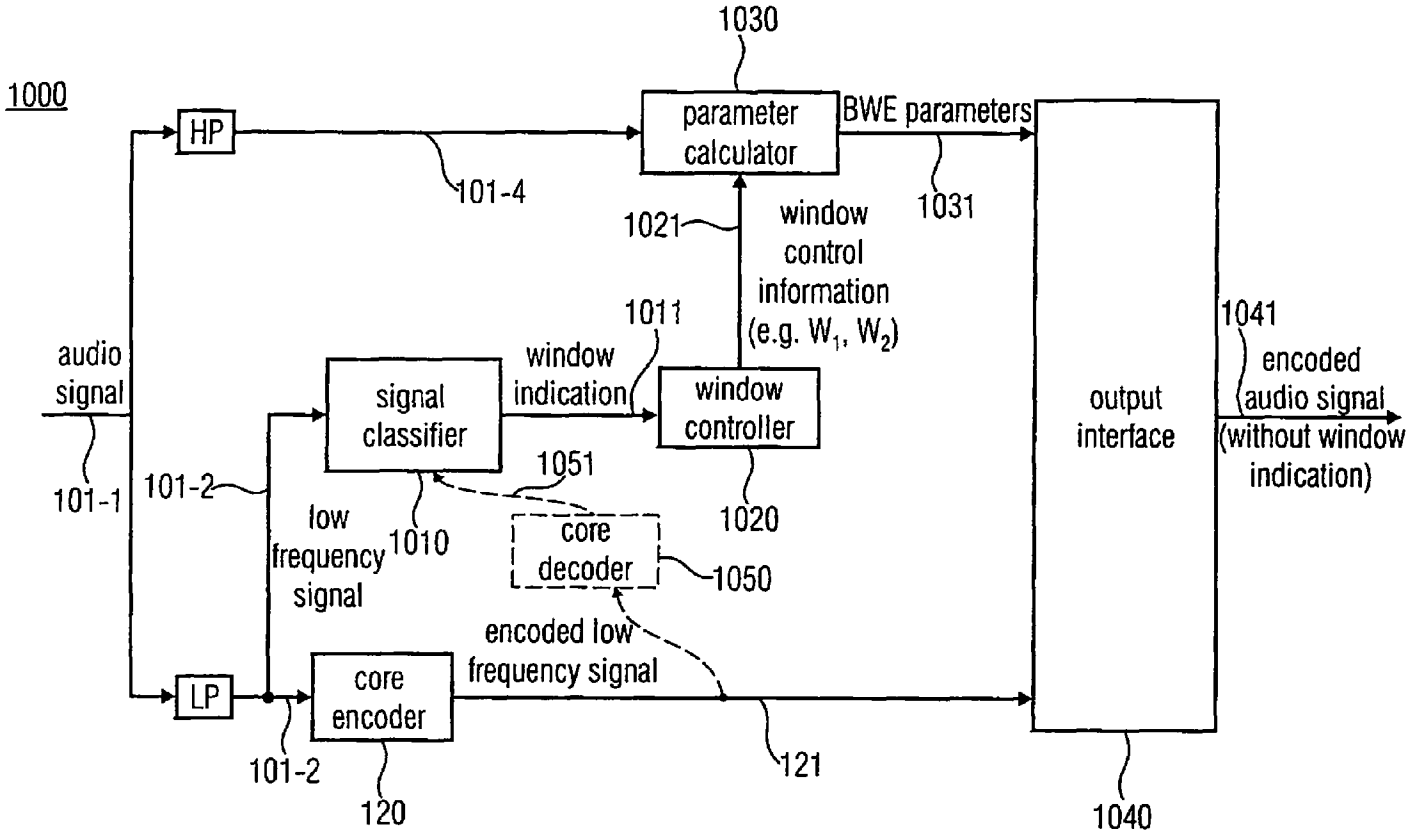
FIG. 10 shows a block diagram of a further embodiment of a bandwidth extension encoder.
Figure 11:
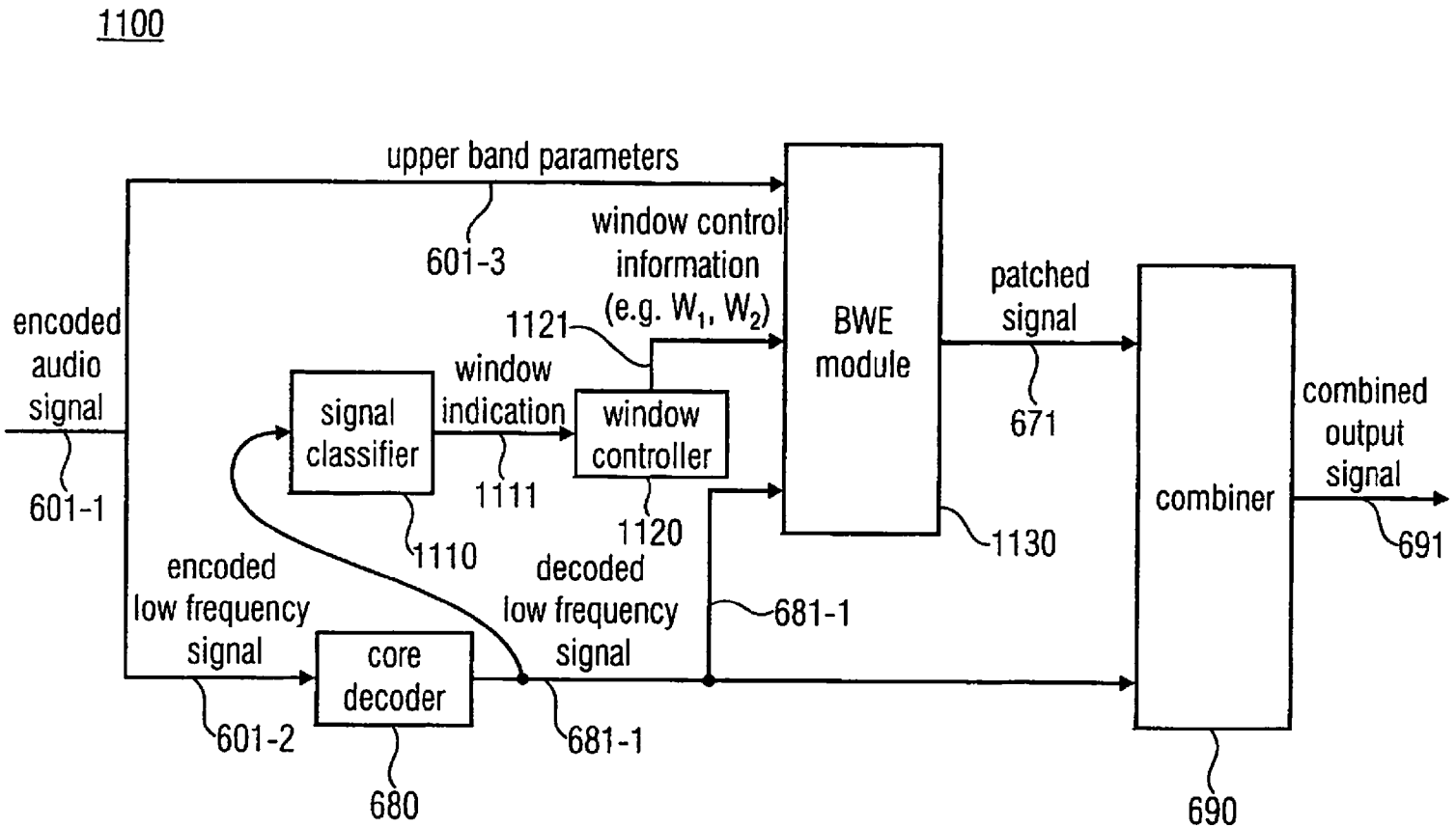
FIG. 11 shows a block diagram of a further embodiment of a bandwidth extension decoder.

FIG. 9 shows a block diagram of an implementation of a signal classifier 900, which may be used for the direct analysis of the audio signal 101-1 in the embodiment of FIGS. 8, 10 and 11. The signal classifier 900 may comprise a tonality measurer 910, a signal characterizer 920 and a window selector 930. The tonality measurer 910 may be configured to analyze the audio signal 101-1 in order to determine a tonality measure 911 of the audio signal 101-1. The signal characterizer 920 may be configured to determine a signal characteristic 921 of the audio signal 101-1 based on the tonality measure 911 provided by the tonality measurer 910. In particular, the signal characterizer 920 is configured to determine whether the audio signal 101-1 corresponds to a noisy signal or rather to a tonal signal. Finally, the window selector 930 is implemented to provide the window indication 811 based on the signal characteristic 921.

FIG. 10 shows a block diagram of a further embodiment of a bandwidth extension encoder 1000, which may correspond to the bandwidth extension encoder 500 shown in FIG. 5. Correspondingly, identical blocks in the embodiments shown in FIGS. 5 and 10 are denoted by the same numerals. The signal analyzer 110 of the bandwidth extension encoder 1000 comprises a signal classifier 1010, wherein the signal classifier 1010 is configured to classify the low frequency signal 101-2 derived from the audio signal 101-1 for determining a window indication 1011 corresponding to an analysis window function based on a signal characteristic of the classified signal provided by the signal classifier 1010. Furthermore, the encoder 1000 comprises a window controller 1020 for providing window control information 1021 based on the window indication 1011 determined by the signal classifier 1010. The parameter calculator 1030 of the bandwidth extension encoder 1000 comprises a windower controlled by the window controller 1020, wherein the windower of the parameter calculator 1030 is configured to apply an analysis window function based on the window control information 1021 to the high frequency signal 101-4 to obtain BWE parameters 1031. The bandwidth extension encoder 1000 may comprise a core encoder 120 for encoding the low frequency signal 101-2 to obtain an encoded low frequency signal 121. Moreover, the bandwidth extension encoder 1000 may also optionally comprise a core decoder 1050 indicated by the dashed block, which is configured to decode the encoded low frequency signal 121 to obtain a decoded low frequency signal 1051 (dashed arrow). Correspondingly, the signal classifier 1010 may optionally be configured to analyze/classify the decoded low frequency signal 1051 in order to determine the window indication 1011. The encoded low frequency signal 121 and the BWE parameters 1031 may further be supplied to an output interface 1040, which is configured for providing an encoded audio signal 1041 not comprising the window indication 1011. Here, the encoded audio signal 1041 may correspond to the encoded audio signal 531 shown in FIG. 5.

In this case, the window indication is not contained in the encoded audio signal on the encoder side (FIG. 10), which means that the window indication has to be determined on the decoder side (FIG. 11) as well, as will be illustrated in the following.

FIG. 11 shows a block diagram of a further embodiment of a bandwidth extension decoder 1100, which may correspond to the bandwidth extension decoder 600 shown in FIG. 6. Correspondingly, identical blocks in the embodiments of FIGS. 6 and 11 are denoted by the same numerals. In particular, the bandwidth extension decoder 1100 comprises a core decoder 680 for decoding the encoded low frequency signal 601-2 to obtain a decoded low frequency signal 681-1. The patch module 220 of the bandwidth extension decoder 1100 comprises a signal classifier 1110, which is configured to analyze/classify the decoded low frequency signal 681-1 for determining a window indication 1111 corresponding to an analysis window function based on a signal characteristic of the analyzed signal. Furthermore, the decoder 1100 comprises a window controller 1120 for providing window control information 1121 based on the window indication 1111 determined by the signal classifier 1110. In addition, the decoder 1100 may comprise a BWE module 1130, which may be configured such that the patch module 220 will generate a patched signal 671 based on the decoded low frequency signal 681-1, the analysis window function based on the window control information 1121 and the upper band parameter 601-

3. The patched signal 671 and the decoded low frequency signal 681-1 may be further combined by a combiner 690 to obtain a combined output signal 691.

Figure 12:
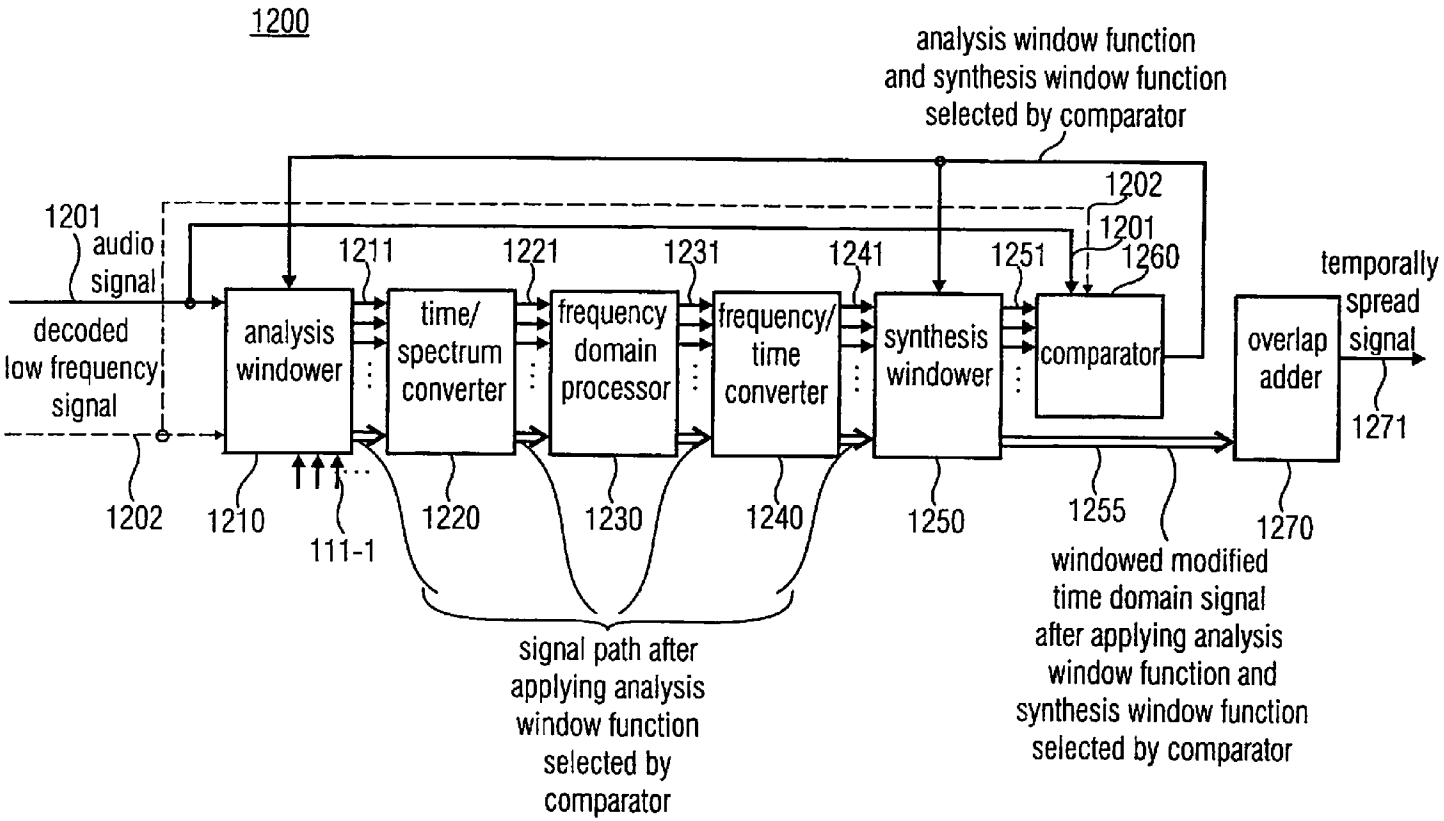
FIG. 12 shows a block diagram of an embodiment of a phase vocoder processor.

The analysis-by-synthesis scheme of the previous embodiments may also be used in the context of a phase vocoder implementation. Accordingly, FIG. 12 shows a block diagram of an embodiment of a phase vocoder processor 1200. The phase vocoder processor 1200 for processing an audio signal 1201 may comprise an analysis windower 1210, a time/spectrum converter 1220, a frequency domain processor 1230, a frequency/time converter 1240, a synthesis windower 1250, a comparator 1260 and an overlap adder 1270. Specifically, the analysis windower 1210 may be configured for applying a plurality 111-1 of analysis window functions to the audio signal 1201 or a signal derived from the audio signal such as the decoded low frequency signal 1202 indicated by the dashed arrow, the audio signal 1201 having a block of audio samples, the block having a specified length in time, to obtain a plurality 1211 of windowed audio signals. The time/spectrum converter 1220 may be configured for converting the windowed audio signals 1211 into spectra 1221. The frequency domain processor 1230 may be configured for processing the spectra 1221 in a frequency domain to obtain modified spectra 1231. The frequency/time converter 1240 may be configured for converting the modified spectra 1231 into modified time domain signals 1241. The synthesis windower 1250 may be configured for applying a plurality of synthesis window functions to the modified time domain signals 1241, wherein the synthesis window functions are matched to the analysis window functions, to obtain windowed modified time domain signals 1251. The comparator 1260 may furthermore be configured to determine a plurality of comparison parameters based on a comparison of the plurality of windowed modified time domain signals 1251 and the audio signal 1201 or a signal derived from the audio signal such as the decoded low frequency signal 1202 (dashed line), wherein the plurality of comparison parameters corresponds to the plurality of analysis window functions, and wherein the comparator 1260 is furthermore configured to select an analysis window function and a synthesis window function for which a comparison parameter satisfies a predetermined condition. Here, it is to be noted that the analysis window function and the synthesis window function selected by the comparator 1260 may be determined in a similar way as has been described before in the context of the previous embodiments. In particular, the comparator 1260 may be implemented as in the embodiment shown in FIG. 7. Subsequently, the selected analysis window function and the synthesis window function may be used for a signal path starting at the analysis windower 1210 and ending with the synthesis windower 1250 before the comparator 1260 in the processing chain as shown in FIG. 12 such that a specific (optimized) windowed modified time domain signal 1255 will be obtained at the output of the synthesis windower 1250. Finally, the overlap adder 1270 may be configured for adding overlapping consecutive blocks of the windowed modified time domain signal 1255 having been modified by the analysis window function and synthesis window function selected by the comparator 1260 to obtain a temporally spread signal 1271.

In particular, the temporally spread signal 1271 can be obtained by spacing the overlapping consecutive blocks of the windowed modified time domain signal 1255 further apart from each other than the corresponding blocks of the original audio signal 1201 or the decoded low frequency signal 1202. Additionally, the overlap adder 1270 here acting as a signal spreader may also be configured to temporally spread the audio signal 1201 or the decoded low frequency signal 1202 in that the pitch of the same will not be changed, leading to a scenario of "pure time stretching".

Alternatively, the comparator 1260 may also be placed after the overlap adder 1270 in the processing chain such that the latter will also be included in the analysis-by-synthesis scheme, which may be advantageous insofar as in this case, effects of the different windowed modified time domain signals 1251 processed by the overlap adder 1270 may also be accounted for by a subsequent comparison/window selection.

In further alternative embodiments, the phase vocoder processor 1200 may also comprise a decimator in form of, for example, a simple sample rate converter, wherein the decimator may be configured to decimate (compress) the spreaded signal such that a decimated signal in a target frequency range of a bandwidth extension algorithm will be obtained.

In further alternative embodiments, a phase vocoder processor may also be implemented to perform a direct analysis of an input audio signal with the aim to select an optimal analysis window function adapted to the signal characteristic of the analyzed audio signal. Particularly, it was found that certain signals benefit from using specialized analysis windows for the phase vocoder. For instance, noisy signals are better analyzed by application of, for example, a Tukey window, while predominantly tonal signals benefit from a small main lobe of the transfer function as provided by, e.g., the Bartlett window.

In summary, it can be seen that the procedure of selecting the optimum window function can either be performed only on the encoder side such as within the bandwidth extension encoders 300 and 800 of FIGS. 3 and 8, wherein then the provided window indication is transmitted to the decoder side such as the bandwidth extension decoder 400 of FIG. 4, or both at the encoder and the decoder side such as with regard to the bandwidth extension encoders/decoders 500 and 600 of FIGS. 5 and 6 or the bandwidth extension encoders/decoders 1000 and 1100 of FIGS. 10 and 11.

In this context, it may be of advantage that in the latter case, the window indication is not to be stored as additional side-information within the encoded audio signal such that the bit rate for storage or transmission of the encoded audio signal may be reduced.

Figure 13:
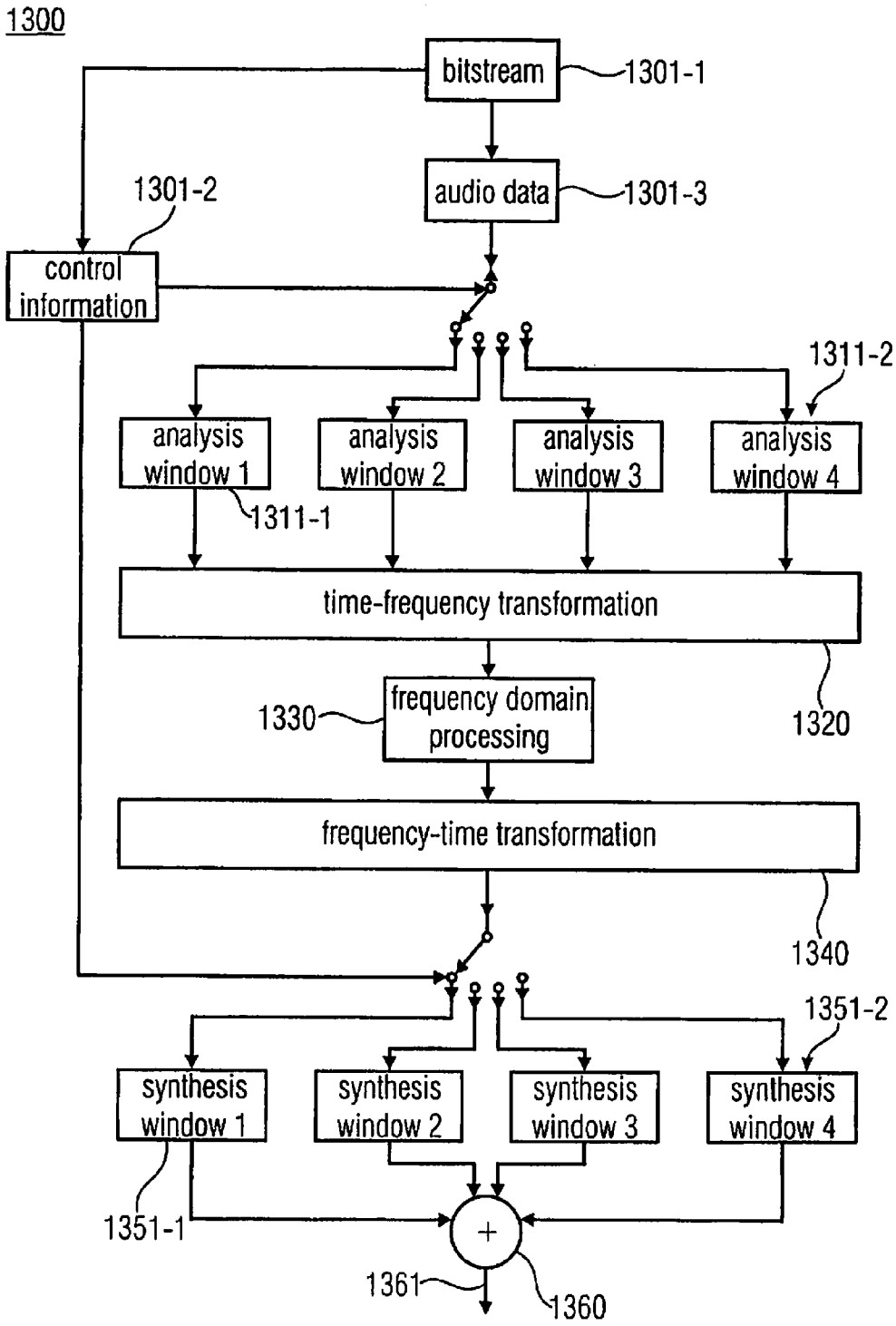
FIG. 13 shows a block diagram of an embodiment of an apparatus for switching between different analysis and synthesis windows dependent on control information.

FIG. 13 illustrates an embodiment of an apparatus 1300, which may be used for switching between different analysis and synthesis windows dependent on control information in the context of time-frequency transforms applicable for phase vocoder applications. The incoming bitstream 1301-1 may be interpreted by a datastream interpreter, which is implemented to separate the control information 1301-2 from the audio data 1301-3. Furthermore, depending on the control information 1301-2, an analysis window function 1311-1 from a plurality 1311-2 of analysis windows may be applied to the audio data 1301-3. Here, exemplarily, the plurality 1311-2 of analysis windows comprises four different analysis windows denoted by the blocks "analysis window 1" to "analysis window 4", wherein the block "analysis window 1" refers to the applied analysis window 1311-1. The control information 1301-2, in particular, may have been obtained by a direct calculation of the signal characteristic or an analysis-by-synthesis scheme as described correspondingly before. In case of a noisy signal, for example, a Tukey window may be chosen, while in case of a tonal signal, for example, a Bartlett window may be chosen. The Tukey window, which may also be referred to as a cosine-tapered window, may be imaged as a cosine lobe of width $(\alpha \cdot 2)$ N convolved with a rectangular window of width $(1.0-\alpha \cdot 2)$ N. The Tukey window may be defined by $$w(n)\begin{cases} 1.0, & 0 \le |n| \le \alpha\frac{N}{2} \\ 0.5\left[1.0+\cos\left[\pi\frac{n-\alpha\frac{N}{2}}{2(1-\alpha)\frac{N}{2}}\right]\right], & \alpha\frac{N}{2} \le |n| \le \frac{N'}{2} \end{cases} \quad (1)$$

wherein the window evolves from the rectangular window to the Hanning window as the parameter $\alpha$ varies from 0 to unity. The Bartlett window representing a triangular window may be defined as $$w(n) = 1.0 - \frac{|n|}{N/2}. \quad (2)$$

In Eqs. (1) and (2), n is an integer value and N the width (in samples) of the time-discrete window functions w(n).

The windowed audio signal obtained after applying the analysis window 1311-1 may further be transformed in a block 1320 denoted by "time-frequency transformation" from the time domain to a frequency domain. The obtained spectrum may then be processed in a block 1330 denoted by "frequency domain processing". In particular, the block 1330 may comprise a phase modifier for modifying phases of spectral values of the spectrum. Then, the processed spectrum may be transformed in a block 1340 denoted by "frequency-time transformation" back into the time domain to obtain a modified time domain signal. Finally, depending on the control information 1301-2, a synthesis window 1351-1 from a plurality of synthesis windows 1351-2 denoted by "synthesis window 1" to synthesis window 4", wherein the synthesis window 1351-1 compensates for the effect of the analysis window 1311-1, may be applied to the modified time domain signal to obtain, after adding contributions from all possible signal paths in a block 1360 indicated by a plus symbol, the windowed modified time domain signal 1361 at the output of the apparatus 1300.

Figures 14A, 14B:
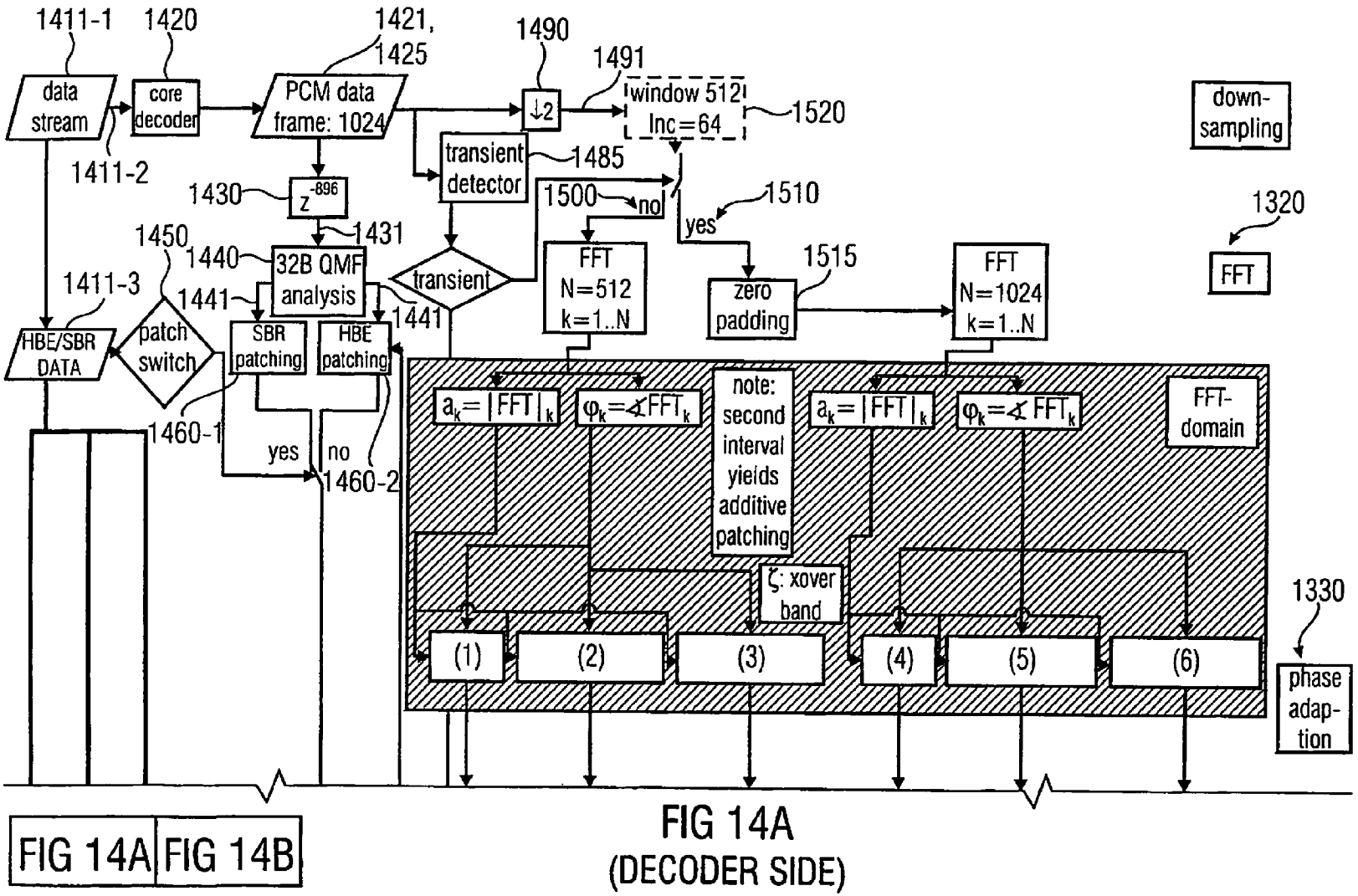
FIG. 14 shows an overview of an embodiment of a phase vocoder driven bandwidth extension decoder.
Figures 14A, 14B:
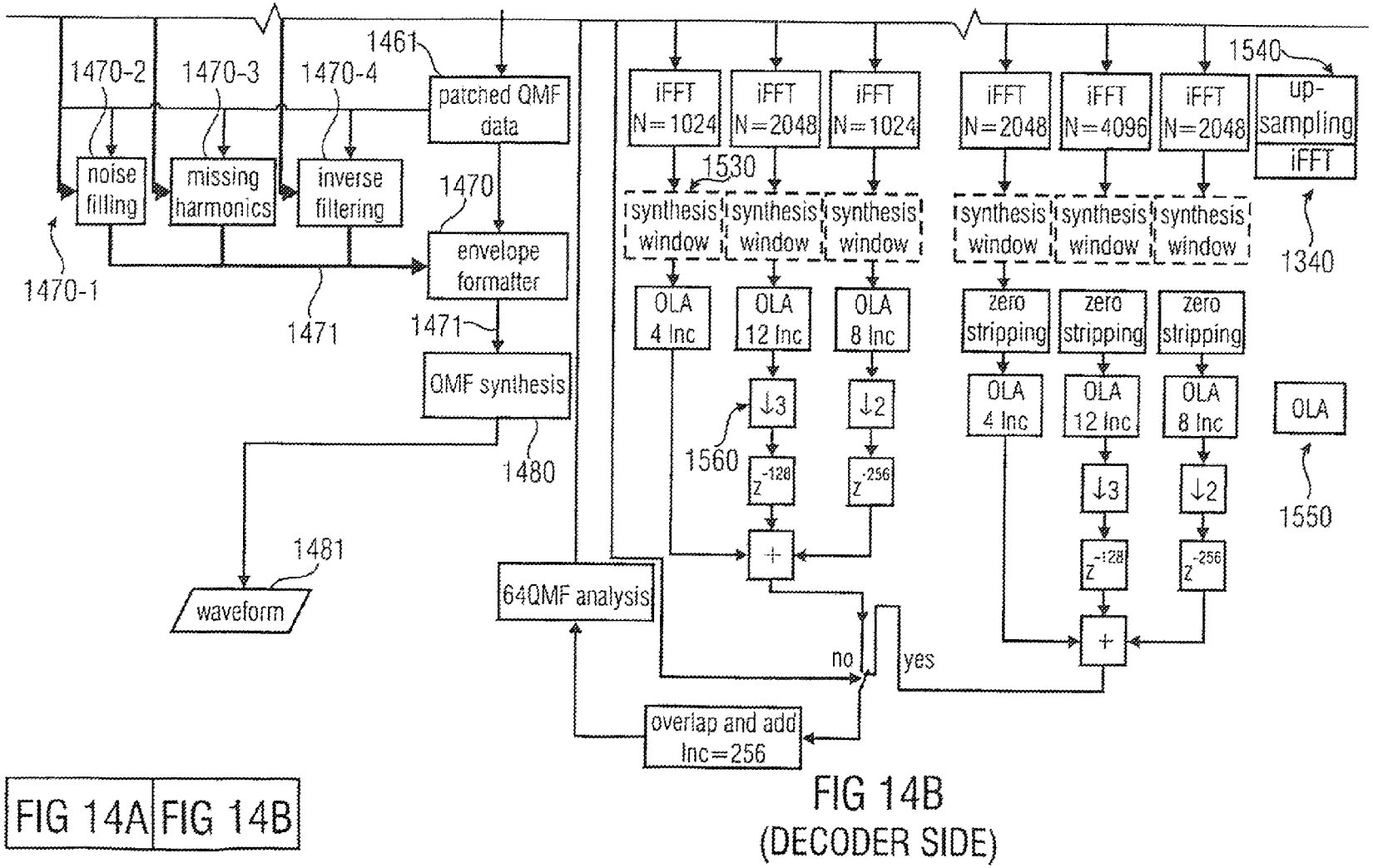

FIG. 14 shows an overview of an embodiment of a phase vocoder driven bandwidth extension decoder 1400. In particular, a data audio stream 1411-1 may be separated into an encoded low frequency signal 1411-2 and HBE/SBR data 1411-3. The encoded low frequency signal 1411-2 may be decoded by a core decoder 1420 to obtain a decoded low frequency signal 1421 comprising a core frequency band 1425. The decoded low frequency signal 1421 may, for example, represent PCM (pulse code modulation) data having a frame size of 1024. The decoded low frequency signal 1421 is further supplied to a delay stage 1430 to obtain a delayed signal 1431. Subsequently, the delayed signal 1431 is input into a 32-band QMF (quadrature mirror filter) analysis bank 1440, generating, for example, 32 frequency subbands 1441 of the delayed signal 1431. The HBE/SBR data 1411-3 may comprise control information for controlling a patch switch 1450, wherein the patch switch 1450 is configured for switching between a SBR patching algorithm and an HBE patching algorithm. In case of the SBR patching algorithm, the frequency subbands 1441 are supplied to a SBR patching device 1460-1 in order to obtain patched QMF data 1461. The patched QMF data 1461 present at the output of the SBR patching device 1460-1 are supplied to an HBE/SBR tool 1470-1 comprising, for example, a noise filling unit 1470-2, a missing harmonics reconstruction unit 1470-3 or an inverse filtering unit 1470-4. In particular, the HBE/SBR tool 1470-1 may implement known spectral band replication techniques to be used on the patched QMF data 1461. The patching algorithm used by the SBR patching device 1460-1 may, for example, use a mirroring or copying of the spectral data within the frequency domain. Furthermore, the HBE/SBR tool 1470-1 is controlled by the HBE/SBR data 1411-3. The patched QMF data 1461 and the output 1471 of the HBE/SBR tool 1470-1 are supplied to an envelope formatter 1470. The envelope formatter 1470 is implemented to adjust the envelope for the generated patch such that an envelope-adjusted patched signal 1471 comprising an upper frequency band is generated. The envelope-adjusted signal 1471 is supplied to a QMF synthesis bank 1480, which is configured to combine the components of the upper frequency band with the audio signal in the frequency domain 1441. Finally, a synthesis audio signal 1481 denoted by "waveform" is obtained.

In case of the HBE patching algorithm (block 1460-2), the decoded low frequency signal 1421 may be down-sampled by a down sampler 1490 by, for example, a factor of 2 to obtain a down-sampled version of the decoded low frequency signal 1491. The down-sampled signal 1491 may further be processed in an advanced processing scheme of a harmonic bandwidth extension algorithm using a phase vocoder.

On the one hand, a signal dependent processing scheme may be employed, making use of the switching between a standard algorithm as illustrated by a signal path 1500 denoted by "no" when a transient event is not detected in a block of the decoded low frequency signal 1421 by a transient detector 1485 and an advanced algorithm as illustrated by a signal path 1510 denoted by "yes" starting from a zero padding operation (block 1515) when a transient event is detected in the block.

On the other hand, essentially, a signal dependent switching of analysis window characteristics within a phase vocoder in a time-frequency transform implementation may be performed as has been described in detail before. In particular, in FIG. 14, the boxes referenced by 1520; 1530 with dotted borders indicate the windows that can be altered by the signaling. Basically, FIG. 14 shows the application of the embodiment of FIG. 13 within a phase vocoder driven bandwidth extension.

Here, the blocks denoted by "FFT" (Fast Fourier Transform), "phase adaption" and "iFFT" (inverse Fast Fourier Transform) may correspond to the blocks 1320, 1330 and 1340 shown in FIG. 13, respectively. Specifically, the FFT and iFFT processing blocks may be implemented to apply a short-time Fourier transform (STFT) or a discrete Fourier transform (DFT) and an inverse short-time Fourier transform (iSTFT) or an inverse discrete Fourier transform (iDFT) to a block of the decoded low frequency signal 1421, respectively. In addition, the bandwidth extension decoder 1400 shown in FIG. 14 may also comprise an up-sampling stage 1540, an overlap add (OLA) stage 1550 and a decimation stage 1560.

It is to be noted that with the above concept, it is possible to switch between different windows on arbitrary positions in the audio signal.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

The described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

Dependent on certain implementation requirements of the inventive methods, the inventive methods can be implemented in hardware or in software. The implementation can be performed using a digital storage medium, in particular a disc, a DVD or a CD having electronically, readable control signals stored thereon, which co-operate with programmable computer systems, such that the inventive methods are performed. Generally, the present invention can therefore be implemented as a computer program product with the program code stored on a machine-readable carrier, the program code being operated for performing the inventive methods when the computer program product runs on a computer. In other words, the inventive methods are, therefore, a computer program having a program code for performing at least one of the inventive methods when the computer program runs on a computer. The inventive encoded audio signal can be stored on any machine-readable storage medium, such as a digital storage medium.

The advantages of the novel processing are that the above-mentioned embodiments, i.e. apparatus, methods or computer programs, described in this application allow improving the perceptual audio quality of bandwidth extension applications. In particular, it utilizes a signal-dependent switching of analysis window characteristics such as within a phase vocoder driven bandwidth extension.

The novel processing can also be used in other phase vocoder applications such as pure time stretching whenever it is beneficial to take into account signal characteristics for the choice of an optimal analysis or synthesis window.

The presented concept allows the bandwidth extension to take into account signal characteristics for the patching process. The decision for the best-suited analysis window can be done within an open or within a closed loop. Therefore, the restitution quality can be optimized and, thus, further enhanced.

Most prominent applications are audio decoders based on bandwidth extension principles. However, the inventive processing may also enhance phase vocoder applications for music production or audio post-processing.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A bandwidth extension encoder for encoding an audio signal, the audio signal comprising a low frequency signal comprising a core frequency band and a high frequency signal comprising an upper frequency band, the encoder comprising:

a signal analyzer for analyzing the audio signal, the audio signal comprising a block of audio samples, the block comprising a specified length in time, wherein the signal analyzer is configured for determining, from a plurality of analysis windows, an analysis window to be used for performing a bandwidth extension in a bandwidth extension decoder;

a core encoder for encoding the low frequency signal to obtain an encoded low frequency signal;

a parameter calculator for calculating bandwidth extension parameters from the high frequency signal;

a window controller for providing window control information indicating a plurality of analysis window functions, wherein the parameter calculator comprises a windower controlled by the window controller, wherein the windower is configured to apply the plurality of analysis window functions and an analysis window function to be selected by a comparator to the high frequency signal, the signal analyzer comprising a patch module, which is configured to generate a plurality of patched signals based on the low frequency signal, the window control information and bandwidth extension parameters, wherein the patched signals comprise upper frequency bands generated from the core frequency band; and the comparator configured to determine a plurality of comparison parameters based on a comparison of the patched signals and a reference signal being the audio signal or a signal derived from the audio signal, wherein the plurality of comparison parameters corresponds to the plurality of analysis window functions, and wherein the comparator is furthermore configured to provide a window indication corresponding to an analysis window function for which a comparison parameter satisfies a predetermined condition; and an output interface for providing an encoded audio signal, the encoded audio signal comprising the window indication.

2. A bandwidth extension encoder according to claim 1, further comprising:

a window controller for providing window control information indicating a plurality of analysis window functions, the parameter calculator comprising a windower controlled by the window controller, wherein the windower is configured to apply the plurality of analysis window functions and an analysis window function to be selected by a comparator to the high frequency signal, the signal analyzer comprising a patch module, which is configured to generate a plurality of patched signals based on the low frequency signal, the window control information and bandwidth extension parameters, wherein the patched signals comprise upper frequency bands generated from the core frequency band, and wherein the patch module comprises a windower controlled by the window controller, wherein the windower is configured for applying the plurality of analysis window functions to the low frequency signal;

a comparator which is configured to determine a plurality of comparison parameters based on a comparison of the patched signals and a reference low frequency signal derived from the audio signal, wherein the plurality of comparison parameters corresponds to the plurality of analysis window functions, and wherein the comparator is furthermore configured to provide a window indication corresponding to an analysis window function for which a comparison parameter satisfies a predetermined condition; and an output interface for providing an encoded audio signal, the encoded audio signal not comprising the window indication.

3. A bandwidth extension encoder according to claim 2, further comprising:

a core decoder for decoding the encoded low frequency signal to obtain a decoded low frequency signal.

4. A bandwidth extension encoder according to claim 1, wherein the comparator is configured for calculating a plurality of SFM parameters for the patched signals or the windowed modified time domain signals and a reference SFM parameter derived from the audio signal or the decoded low frequency signal and for determining the plurality of comparison parameters based on a comparison of the SFM parameters and the reference SFM parameter.

5. A bandwidth extension encoder according to claim 1, the signal analyzer comprising a signal classifier, wherein the signal classifier is configured to classify the audio signal or a signal derived from the audio signal for determining a window indication corresponding to an analysis window function based on a signal characteristic of the classified signal, the encoder comprising a window controller for providing window control information based on the window indication determined by the signal classifier, the parameter calculator comprising a windower controlled by the window controller, wherein the windower is configured to apply an analysis window function based on the window control information to the high frequency signal, and the encoder further comprising an output interface for providing an encoded audio signal, the encoded audio signal comprising the window indication.

6. A bandwidth extension encoder according to claim 1, the signal analyzer comprising a signal classifier, wherein the signal classifier is configured to classify a low frequency signal derived from the audio signal for determining a window indication corresponding to an analysis window function based on a signal characteristic of the classified signal, the encoder comprising a window controller for providing window control information based on the window indication determined by the signal classifier, the parameter calculator comprising a windower controlled by the window controller, wherein the windower is configured to apply an analysis window function based on the window control information to the high frequency signal, and the encoder further comprising an output interface for providing an encoded audio signal, the encoded audio signal not comprising the window indication.

7. A bandwidth extension decoder for decoding an encoded audio signal, the encoded audio signal comprising an encoded low frequency signal and upper band parameters, the decoder comprising:

a core decoder for decoding the encoded low frequency signal, wherein the decoded low frequency signal comprises a core frequency band;

a patch module which is configured to generate a patched signal based on the decoded low frequency signal and the upper band parameters, wherein the patched signal comprises an upper frequency band generated from the core frequency band; and a combiner which is configured to combine the patched signal and the decoded low frequency signal to obtain a combined output signal, wherein the patch module comprises:

an analysis windower for applying a plurality of analysis window functions to the decoded low frequency signal to obtain a plurality of windowed low frequency signals;

a time/spectrum converter for converting the windowed low frequency signals into spectra;

a frequency domain processor for processing the spectra in a frequency domain to obtain modified spectra;

a frequency/time converter for converting the modified spectra into modified time domain signals;

a synthesis windower for applying a plurality of window functions to the modified time domain signals, wherein the synthesis window functions are matched to the analysis window functions to obtain windowed modified time domain signals; and a comparator which is configured to determine a plurality of comparison parameters based on a comparison of the plurality of windowed modified time domain signals and the decoded low frequency signal, wherein the plurality of comparison parameters corresponds to the plurality of analysis window functions, and wherein the comparator is furthermore configured to select an analysis window function and a synthesis window function for which a comparison parameter satisfies a predetermined condition, and wherein the patch module is configured for generating a patched signal based on the decoded low frequency signal, the analysis window function and the synthesis window function selected by the comparator and the upper band parameters.

8. A bandwidth extension decoder according to claim 7, wherein the encoded audio signal comprises a window indication, and wherein the patch module comprises a controllable windower for selecting an analysis window function from a plurality of analysis window functions based on the window indication and for applying the selected analysis window function to the decoded low frequency signal.

9. A bandwidth extension decoder according to claim 7, wherein the patch module comprises:

a signal classifier which is configured to classify the decoded low frequency signal for determining a window indication corresponding to an analysis window function based on a signal characteristic of the classified signal, the decoder comprising a window controller for providing window control information based on the window indication determined by the signal classifier, and wherein the patch module is configured for generating a patched signal based on the decoded low frequency signal, an analysis window function based on the window control information and the upper band parameters.

10. A phase vocoder processor for processing an audio signal, comprising:

an analysis windower for applying a plurality of analysis window functions to the audio signal or a signal derived from the audio signal, the audio signal comprising a block of audio samples, the block comprising a specified length in time, to obtain a plurality of windowed audio signals;

a time/spectrum converter for converting the windowed audio signals into spectra;

a frequency domain processor for processing the spectra in a frequency domain to obtain modified spectra;

a frequency/time converter for converting the modified spectra into modified time domain signals;

a synthesis windower for applying a plurality of synthesis window functions to the modified time domain signals, wherein the synthesis window functions are matched to the analysis window functions, to obtain windowed modified time domain signals;

a comparator which is configured to determine a plurality of comparison parameters based on a comparison of the plurality of windowed modified time domain signals and the audio signal or a signal derived from the audio signal, wherein the plurality of comparison parameters corresponds to the plurality of analysis window functions, and wherein the comparator is furthermore configured to select an analysis window function and a synthesis window function for which a comparison parameter satisfies a predetermined condition; and an overlap adder for adding overlapping blocks of a windowed modified time domain signal to obtain a temporally spreaded signal, wherein the overlap adder is configured for processing blocks of the windowed modified time domain signal having been modified by an analysis window function and a synthesis window function selected by the comparator.

11. A method for encoding an audio signal, the audio signal comprising a low frequency signal comprising a core frequency band and a high frequency signal comprising an upper frequency band, the method comprising:

analyzing the audio signal, the audio signal comprising a block of audio samples, the block comprising a specified length in time, for determining, from a plurality of analysis windows, an analysis window to be used for performing a bandwidth extension in a bandwidth extension decoder;

encoding the low frequency signal to obtain an encoded low frequency signal;

calculating bandwidth extension parameters from the high frequency signal;

providing window control information indicating a plurality of analysis window functions, wherein the calculating bandwidth extension parameters comprises applying the plurality of analysis window functions and an analysis window function to be selected to the high frequency signal, wherein the analyzing comprises generating a plurality of patched signals based on the low frequency signal, the window control information and bandwidth extension parameters, wherein the patched signals comprise upper frequency bands generated from the core frequency band;

determining a plurality of comparison parameters based on a comparison of the patched signals and a reference signal being the audio signal or a signal derived from the audio signal, wherein the plurality of comparison parameters corresponds to the plurality of analysis window functions, and providing a window indication corresponding to an analysis window function for which a comparison parameter satisfies a predetermined condition; and providing an encoded audio signal, the encoded audio signal comprising the window indication.

12. A method for decoding an encoded audio signal, the encoded audio signal comprising an encoded low frequency signal and upper band parameters, the method comprising:

decoding the encoded low frequency signal, wherein the decoded low frequency signal comprises a core frequency band;

generating a patched signal based on the decoded low frequency signal and the upper band parameters, wherein the patched signal comprises an upper frequency band generated from the core frequency band; and combining the patched signal and the decoded low frequency signal to obtain a combined output signal, wherein the generating a patched signal comprises:

applying a plurality of analysis window functions to the decoded low frequency signal to obtain a plurality of windowed low frequency signals;

converting the windowed low frequency signals into spectra;

processing the spectra in a frequency domain to obtain modified spectra;

converting the modified spectra into modified time domain signals;

applying a plurality of window functions to the modified time domain signals, wherein the synthesis window functions are matched to the analysis window functions to obtain windowed modified time domain signals;

determining a plurality of comparison parameters based on a comparison of the plurality of windowed modified time domain signals and the decoded low frequency signal, wherein the plurality of comparison parameters corresponds to the plurality of analysis window functions, and selecting an analysis window function and a synthesis window function for which a comparison parameter satisfies a predetermined condition, and wherein the patched signal is generated based on the decoded low frequency signal, the analysis window function and the synthesis window function selected and the upper band parameters.

13. A non-transitory storage medium having stored thereon a computer program comprising a program code for performing the method for encoding an audio signal, the audio signal comprising a low frequency signal comprising a core frequency band and a high frequency signal comprising an upper frequency band, the method comprising:

analyzing the audio signal, the audio signal comprising a block of audio samples, the block comprising a specified length in time, for determining, from a plurality of analysis windows, an analysis window to be used for performing a bandwidth extension in a bandwidth extension decoder;

encoding the low frequency signal to obtain an encoded low frequency signal;

calculating bandwidth extension parameters from the high frequency signal;

providing window control information indicating a plurality of analysis window functions, wherein the calculating bandwidth extension parameters comprises applying the plurality of analysis window functions and an analysis window function to be selected to the high frequency signal, wherein the analyzing comprises generating a plurality of patched signals based on the low frequency signal, the window control information and bandwidth extension parameters, wherein the patched signals comprise upper frequency bands generated from the core frequency band;

determining a plurality of comparison parameters based on a comparison of the patched signals and a reference signal being the audio signal or a signal derived from the audio signal, wherein the plurality of comparison parameters corresponds to the plurality of analysis window functions, and providing a window indication corresponding to an analysis window function for which a comparison parameter satisfies a predetermined condition; and providing an encoded audio signal, the encoded audio signal comprising the window indication, when the computer program is executed on a computer.

14. A non-transitory storage medium having stored thereon a computer program comprising a program code for performing the method for decoding an encoded audio signal, the encoded audio signal comprising an encoded low frequency signal and upper band parameters, the method comprising:

decoding the encoded low frequency signal, wherein the decoded low frequency signal comprises a core frequency band;

generating a patched signal based on the decoded low frequency signal and the upper band parameters, wherein the patched signal comprises an upper frequency band generated from the core frequency band;

combining the patched signal and the decoded low frequency signal to obtain a combined output signal, wherein the generating a patched signal comprises:

applying a plurality of analysis window functions to the decoded low frequency signal to obtain a plurality of windowed low frequency signals;

converting the windowed low frequency signals into spectra;

processing the spectra in a frequency domain to obtain modified spectra;

converting the modified spectra into modified time domain signals;

applying a plurality of window functions to the modified time domain signals, wherein the synthesis window functions are matched to the analysis window functions to obtain windowed modified time domain signals;

determining a plurality of comparison parameters based on a comparison of the plurality of windowed modified time domain signals and the decoded low frequency signal, wherein the plurality of comparison parameters corresponds to the plurality of analysis window functions, and selecting an analysis window function and a synthesis window function for which a comparison parameter satisfies a predetermined condition, and wherein the patched signal is generated based on the decoded low frequency signal, the analysis window function and the synthesis window function selected and the upper band parameters, when the computer program is executed on a computer.

15. A bandwidth extension encoder for encoding an audio signal to obtain an encoded audio signal, the audio signal comprising a low frequency signal comprising a core frequency band and a high frequency signal comprising an upper frequency band, the encoder comprising:

a signal analyzer for analyzing the audio signal, the audio signal having a block of audio samples, the block having a specified length in time, wherein the signal analyzer is configured for determining, from a plurality of analysis window functions, an analysis window function to be used for performing a bandwidth extension in a bandwidth extension decoder, wherein the signal analyzer comprises a signal classifier, wherein the signal classifier is configured to classify the audio signal or a signal derived from the audio signal for determining a window indication corresponding to the analysis window function based on a signal characteristic of the audio signal;

a window controller for providing window control information based on the window indication determined by the signal classifier, wherein the plurality of analysis window functions indicated by the window control information at an output of the window controller, comprises different analysis window functions having different window characteristics, wherein the analysis window functions have different transfer functions distinguished by their main lobe widths, side lobe levels or side lobe fall-offs;

a core encoder for encoding the low frequency signal to obtain an encoded low frequency signal;

a parameter calculator for calculating bandwidth extension parameters from the high frequency signal, the parameter calculator comprising a windower controlled by the window controller, wherein the windower is configured to apply an analysis window function based on the window control information to the high frequency signal; and an output interface for providing the encoded audio signal, the encoded audio signal comprising the encoded low frequency signal, the bandwidth extension parameters, and the window indication.

16. A bandwidth extension encoder of claim 15, in which the signal classifier comprises:

a tonality measurer configured for analyzing the audio signal in order to determine a tonality measure of the audio signal;

a signal characterizer for determining a signal characteristic of the audio signal based on the tonality measure; and a window selector for providing the window indication based on the signal characteristic.

17. A bandwidth extension encoder of claim 15, wherein the window control information for the parameter provider is provided such that a first window function characterized by a transfer function with a first width of a main lobe is applied by the windower of the parameter calculator, when a determined tonality measure of the audio signal is below a predefined threshold, and such that a second window function characterized by a transfer function with a second width of a main lobe is applied by the windower of the parameter calculator, when the determined tonality measure of the audio signal is equal or above the predefined threshold, wherein the first width of the main lobe is larger than the second width of the main lobe.

18. A bandwidth extension decoder for decoding an encoded audio signal, the encoded audio signal comprising an encoded low frequency signal and upper band parameters and a window indication, the decoder comprising:

a core decoder for decoding the encoded low frequency signal, wherein the decoded low frequency signal comprises a core frequency band;

a patch module which is configured to generate a patched signal based on the decoded low frequency signal and the upper band parameters, wherein the patched signal comprises an upper frequency band generated from the core frequency band, wherein the patch module comprises a controllable windower for selecting an analysis window function from a plurality of analysis window functions based on the window indication and for applying the selected analysis window function to the decoded low frequency signal so that the patched signal is obtained, wherein the plurality of analysis window functions indicated by the window indication comprises different analysis window functions having different window characteristics, wherein the analysis window functions have different transfer functions distinguished by their main lobe widths, side lobe levels or side lobe fall-offs; and a combiner which is configured to combine the patched signal and the decoded low frequency signal to obtain a combined output signal.

19. A method for encoding an audio signal, the audio signal comprising a low frequency signal comprising a core frequency band and a high frequency signal comprising an upper frequency band, the method comprising:

analyzing the audio signal, the audio signal having a block of audio samples, the block having a specified length in time, for determining, from a plurality of analysis window functions, an analysis window function to be used for performing a bandwidth extension in a bandwidth extension decoder, wherein analyzing the audio signal comprises classifying the audio signal or a signal derived from the audio signal using a signal classifier for determining a window indication corresponding to the analysis window function based on a signal characteristic of the audio signal;

providing window control information, using a window controller, based on the window indication determined by the signal classifier, wherein the plurality of analysis window functions indicated by the window control information at an output of the window controller comprises different analysis window functions having different window characteristics wherein the analysis window functions have different transfer functions distinguished by their main lobe widths, side lobe levels or side lobe fall-offs;

encoding the low frequency signal to obtain an encoded low frequency signal;

calculating bandwidth extension parameters from the high frequency signal, the calculating comprising applying an analysis window function based on the window control information to the high frequency signal by a windower controlled by the window controller;

providing an encoded audio signal, by an output interface, the encoded audio signal comprising the encoded low frequency signal, the bandwidth extension parameters, and the window indication.

20. A method for decoding an encoded audio signal, the encoded audio signal comprising an encoded low frequency signal and upper band parameters and a window indication, the method comprising:

decoding the encoded low frequency signal, wherein the decoded low frequency signal comprises a core frequency band;

generating a patched signal based on the decoded low frequency signal and the upper band parameters, wherein the patched signal comprises an upper frequency band generated from the core frequency band, wherein the step of generating a patched signal comprises selecting, by a controllable windower, an analysis window function from a plurality of analysis window functions based on the window indication and applying the selected analysis window function to the decoded low frequency signal so that the patched signal is obtained, wherein the plurality of analysis window functions indicated by the window indication comprises different analysis window functions having different window characteristics, wherein the analysis window functions have different transfer functions distinguished by their main lobe widths, side lobe levels or side lobe fall-offs; and combining the patched signal and the decoded low frequency signal to obtain a combined output signal.

21. A non-transitory storage medium having stored thereon a computer program having a program code adapted to perform the method of claim 19 or claim 20 when the computer program is executed on a computer.

22. A bandwidth extension encoder for encoding an audio signal, the audio signal comprising a low frequency signal comprising a core frequency band and a high frequency signal comprising an upper frequency band, the encoder comprising:

a signal analyzer for analyzing the audio signal, the audio signal comprising a block of audio samples, the block comprising a specified length in time, wherein the signal analyzer is configured for determining, from a plurality of analysis windows, an analysis window to be used for performing a bandwidth extension in a bandwidth extension decoder;

a core encoder for encoding the low frequency signal to obtain an encoded low frequency signal;

a parameter calculator for calculating bandwidth extension parameters from the high frequency signal, wherein the signal analyzer comprises:

a tonality measurer configured for analyzing the audio signal in order to determine a tonality measure of the audio signal;

a signal characterizer for determining a signal characteristic of the audio signal based on the tonality measure; and a window selector for providing the window indication based on the signal characteristic.

23. A bandwidth extension encoder for encoding an audio signal, the audio signal comprising a low frequency signal comprising a core frequency band and a high frequency signal comprising an upper frequency band, the encoder comprising:

a signal analyzer for analyzing the audio signal, the audio signal comprising a block of audio samples, the block comprising a specified length in time, wherein the signal analyzer is configured for determining, from a plurality of analysis windows, an analysis window to be used for performing a bandwidth extension in a bandwidth extension decoder;

a core encoder for encoding the low frequency signal to obtain an encoded low frequency signal; and a parameter calculator for calculating bandwidth extension parameters from the high frequency signal, the parameter calculator comprising a windower;

wherein a first window function characterized by a transfer function with a first width of a main lobe is applied by the windower of the parameter calculator, when a determined tonality measure of the audio signal is below a predefined threshold, and such that a second window function characterized by a transfer function with a second width of a main lobe is applied by the windower of the parameter calculator, when the determined tonality measure of the audio signal is equal or above the predefined threshold, wherein the first width of the main lobe is larger than the second width of the main lobe.

24. A method of encoding an audio signal, the audio signal comprising a low frequency signal comprising a core frequency band and a high frequency signal comprising an upper frequency band, the method comprising:

analyzing the audio signal, the audio signal comprising a block of audio samples, the block comprising a specified length in time, wherein the analyzing comprises determining, from a plurality of analysis windows, an analysis window to be used for performing a bandwidth extension in a bandwidth extension decoder;

core encoding the low frequency signal to obtain an encoded low frequency signal;

calculating bandwidth extension parameters from the high frequency signal, wherein the analyzing comprises:

analyzing the audio signal in order to determine a tonality measure of the audio signal;

determining a signal characteristic of the audio signal based on the tonality measure; and providing a window indication based on the signal characteristic.

25. A method of encoding an audio signal, the audio signal comprising a low frequency signal comprising a core frequency band and a high frequency signal comprising an upper frequency band, the method comprising:

analyzing the audio signal, the audio signal comprising a block of audio samples, the block comprising a specified length in time, wherein analyzing comprises determining, from a plurality of analysis windows, an analysis window to be used for performing a bandwidth extension in a bandwidth extension decoder;

core encoding the low frequency signal to obtain an encoded low frequency signal; and calculating bandwidth extension parameters from the high frequency signal, wherein a first window function characterized by a transfer function with a first width of a main lobe is used in the calculating, when a determined tonality measure of the audio signal is below a predefined threshold, and wherein a second window function characterized by a transfer function with a second width of a main lobe is used in the calculating, when the determined tonality measure of the audio signal is equal or above the predefined threshold, wherein the first width of the main lobe is larger than the second width of the main lobe.

26. A non-transitory storage medium having stored thereon a computer program having a program code adapted to perform the method of claim 24 or claim 25 when the computer program is executed on a computer.

* * * * *

UNITED STATES PATENT AND TRADEMARK OFFICE

CERTIFICATE OF CORRECTION

PATENT NO. : 8,606,586 B2
APPLICATION NO. : 13/335096
DATED : December 10, 2013
INVENTOR(S) : Frederik Nagel et al.

It is certified that error appears in the above-identified patent and that said Letters Patent is hereby corrected as shown below:

On the title page, item (73) Assignee: "Fraunhofer-Gesellschaft zur Foerderung der Angewandten Forschung E.V." should read -- Fraunhofer-Gesellschaft zur Foerderung der angewandten Forschung e.V. --.

Signed and Sealed this
Twentieth Day of September, 2016

Michelle K. Lee

Michelle K. Lee
*Director of the United States Patent and Trademark Office*